US009280123B2

(12) United States Patent
Obata et al.

(10) Patent No.: US 9,280,123 B2
(45) Date of Patent: Mar. 8, 2016

(54) POWER SUPPLY APPARATUS FOR USE IN IMAGE FORMING APPARATUS

(71) Applicant: CANON KABUSHIKI KAISHA, Tokyo (JP)

(72) Inventors: Naohiro Obata, Tokyo (JP); Takashi Sekiguchi, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/698,653

(22) Filed: Apr. 28, 2015

(65) Prior Publication Data

US 2015/0323895 A1 Nov. 12, 2015

(30) Foreign Application Priority Data

May 8, 2014 (JP) ..... 2014-097107

(51) Int. Cl.
*G03G 15/00* (2006.01)
*G05F 1/56* (2006.01)

(52) U.S. Cl.
CPC . *G03G 15/80* (2013.01); *G05F 1/56* (2013.01)

(58) Field of Classification Search
CPC ..... G03G 15/80; H02M 3/157; G05F 1/56
See application file for complete search history.

(56) References Cited

U.S. PATENT DOCUMENTS

2007/0096781 A1* 5/2007 Ito ..... H02M 3/157 327/112
2007/0165429 A1* 7/2007 Selvaraju ..... H02M 3/33592 363/53
2010/0052628 A1* 3/2010 Khayat ..... H02M 3/157 323/234
2011/0150522 A1* 6/2011 Hayasaki ..... G03G 15/80 399/88
2012/0114363 A1* 5/2012 Inukai ..... G03G 15/5004 399/88
2013/0108304 A1* 5/2013 Hayasaki ..... H02M 1/08 399/88

FOREIGN PATENT DOCUMENTS

JP 2002-153062 A 5/2002

* cited by examiner

*Primary Examiner* — David Gray
*Assistant Examiner* — Carla Therrien
(74) *Attorney, Agent, or Firm* — Fitzpatrick, Cella, Harper & Scinto

(57) ABSTRACT

A setting unit sets a high-voltage set value. A first generation unit generates a high voltage based on the set value set by the setting unit and a first reference voltage supplied from a supply unit. A second generation unit generates a second reference voltage by being supplied with the first reference voltage from the supply unit. A comparing unit compares the first reference voltage with the second reference voltage. A storage unit stores a comparison result that has been obtained in advance by the comparing unit comparing the first reference voltage with the second reference voltage. A correction unit corrects the high-voltage set value based on a comparison result that is obtained by the comparing unit when the image forming apparatus is in use and the comparison result that has been obtained in advance and is stored in the storage unit.

21 Claims, 15 Drawing Sheets

POWER SUPPLY APPARATUS FOR USE IN IMAGE FORMING APPARATUS

BACKGROUND OF THE INVENTION

1. Field of the Invention

The present invention relates mainly to a power supply apparatus, and in particular to a power supply apparatus for use in an image forming apparatus.

2. Description of the Related Art

In an image forming apparatus for performing image formation using an electrophotographic process, high voltages are used as a charging voltage, a transfer voltage, and a developing voltage. If such high voltages vary, the image density or the like will also vary. A variation in a resistive element or reference voltage needs to be corrected by adjusting an output voltage using a variable resistance when a high-voltage power supply is manufactured.

Meanwhile, Japanese Patent Laid-Open No. 2002-153062 discloses a power supply apparatus that includes a transformer as a factory default, in which a secondary side output of the transformer is detected, and the detected output value is stored in association with a duty value of a pulse width signal. After shipment from the factory, the power supply apparatus reads the duty value that is associated with a target output value from a storage device and uses the read duty value. Accordingly, adjustment using a variable resistance is not necessary.

According to Japanese Patent Laid-Open No. 2002-153062, a high output voltage can be corrected, but a variation in a reference voltage is not taken into consideration. In order to reduce an influence of the variation in a reference voltage that is to be supplied to the high-voltage power supply, a special IC that generates an accurate reference voltage is needed, causing an increase in manufacturing cost.

SUMMARY OF THE INVENTION

Therefore, the present invention provides a power supply apparatus and an image forming apparatus that generate an accurate high voltage while reducing an influence of a variation in a reference voltage with their relatively inexpensive configurations.

The present invention provides an image forming apparatus comprising the following elements. A setting unit is configured to set a high-voltage set value. A first generation unit is configured to generate a high voltage based on the set value set by the setting unit and a first reference voltage supplied from a supply unit. A second generation unit is configured to generate a second reference voltage by being supplied with the first reference voltage from the supply unit. A comparing unit is configured to compare the first reference voltage with the second reference voltage. A storage unit is configured to store a comparison result that has been obtained in advance by the comparing unit comparing the first reference voltage with the second reference voltage. A correction unit is configured to correct the high-voltage set value based on a comparison result that is obtained by the comparing unit when the image forming apparatus is in use and the comparison result that has been obtained in advance and is stored in the storage unit. The present invention also provides a power supply apparatus.

Further features of the present invention will become apparent from the following description of exemplary embodiments (with reference to the attached drawings).

DESCRIPTION OF THE EMBODIMENTS

Figure 2:
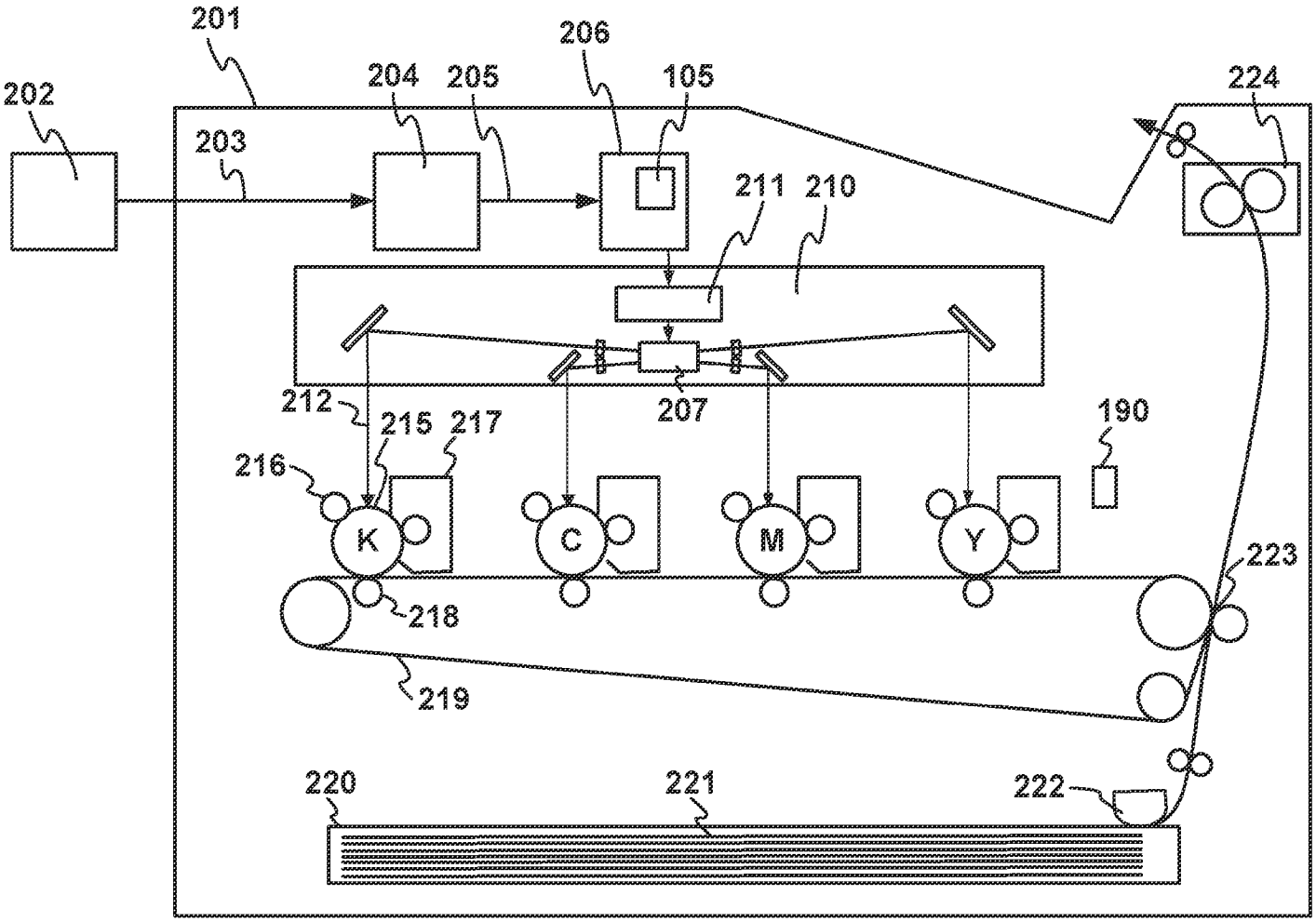
FIG. 2 is a cross-sectional view schematically showing an image forming apparatus.

In Embodiment 1, a method for correcting an output voltage using a regulator and an AD converter in a CPU will be described. FIG. 2 is a cross-sectional view schematically showing a configuration of an image forming apparatus. The image forming apparatus 201 includes a four-color image formation section for forming a color image by overlapping images of four colors (Y: yellow, M: magenta, C: cyan, and Bk: black). Upon receiving image data 203 from a host computer 202, a controller 204 generates a video signal 205. An engine controller 206 includes a calculation processing unit such as a CPU 105 and drives four laser diodes 211 provided in a scanner unit 210 of the image formation section in accordance with the video signal. The laser diodes 211 output laser beams 212 in accordance with the video signal 205. The laser beams 212 are scanned by a rotating polygonal mirror 207, and photoreceptors 215 that are uniformly charged by charging devices 216 are exposed to the laser beams 212. The charging devices 216 execute charging processing using a charging voltage supplied from a power supply apparatus. Accordingly, electrostatic latent images are formed. The electrostatic latent images are developed by developing devices 217, and serve as toner images. Note that each developing device 217 use a developing voltage that is supplied from the power supply apparatus in order to promote development. The toner images are primarily transferred on an endless intermediate transfer belt 219 by a primary transfer members 218. In the primary transfer, a yellow image is first transferred on the intermediate transfer belt 219 and toner images of magenta, cyan, and black are sequentially transferred on one another, and a color image is formed. Each primary transfer member 218 uses a transfer voltage supplied from the power supply apparatus in order to promote primary transfer. The engine controller 206 drives a feed roller 222 to feed a sheet 221 accommodated in a cassette 220 to a delivery path. A secondary transfer roller 223 secondary transfers the toner images primarily transferred on the intermediate transfer belt 219 on the sheet 221. At that time, the secondary transfer roller 223 is supplied with a transfer voltage for promoting secondary transfer from the power supply apparatus. The sheet 221 on which the secondary transfer was performed is subjected to heat fixing with heat and a pressure by a fixing device 224. Note that the engine controller 206 can compulsory drive the laser diodes 211 for the respective colors even without having received a video signal. Hereinafter, light emission that is compulsorily performed without in response to a video signal is referred to as compulsory light emission. A solenoid 190 is a switching unit for switching a plurality of modes in order. The plurality of modes include a mode in which the photoreceptors 215 and the developing devices 217 of all of YMCK are respectively in contact with each other, a mode in which the photoreceptor 215 and the developing device 217 of only K are in contact with each other, and a mode in which the photoreceptors 215 and the developing devices 217 of all of YMCK are respectively moved away from each other. The image formation stations of YMCK may respectively include solenoids 190 or may share only one solenoid 190. In the latter case, the plurality of modes is switched in a cycle in a specific order.

Figure 3:
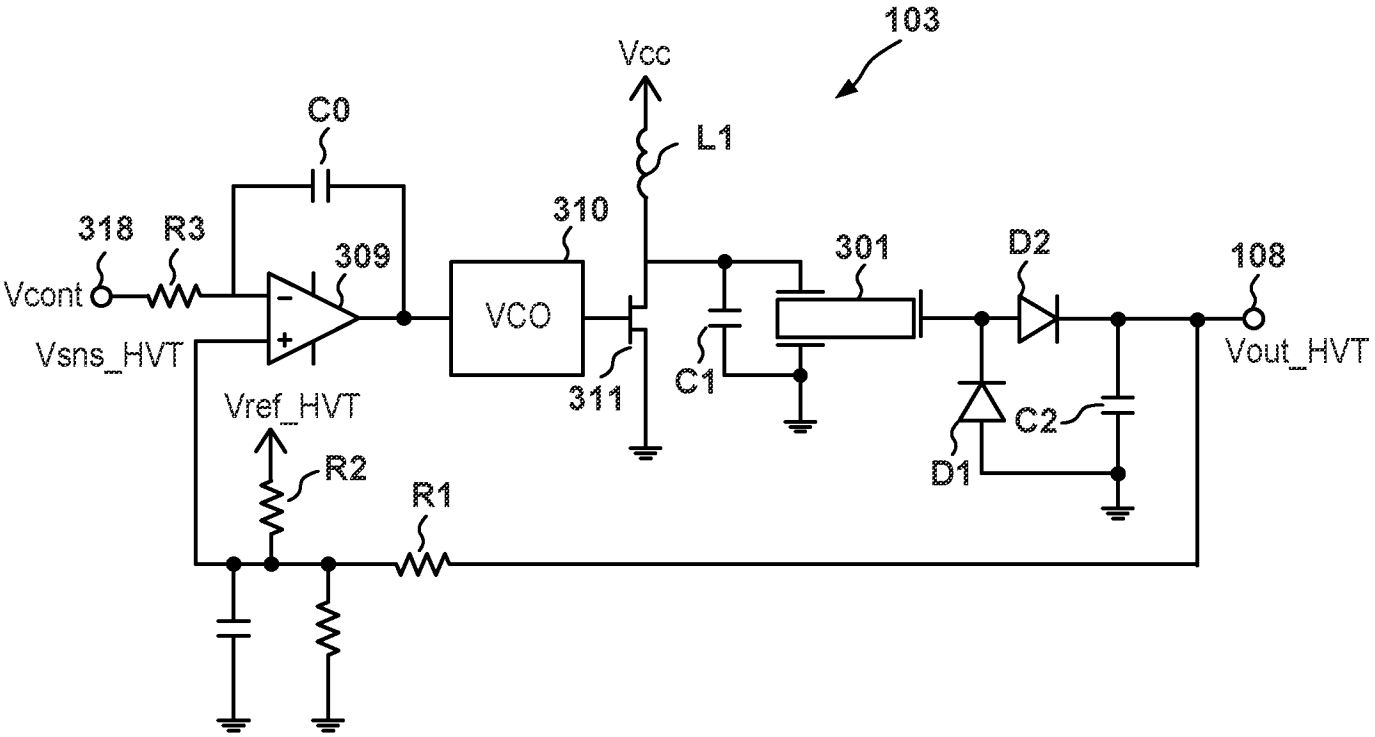
FIG. 3 is a circuit diagram of a high-voltage power supply circuit.

A piezoelectric transformer type high-voltage power supply circuit 103 shown in FIG. 3 is a circuit for generating bias voltages that are to be applied to the charging devices 216, the developing devices 217, the primary transfer members 218, and the secondary transfer roller 223. A piezoelectric transformer 301 is employed in place of a wire wound type electromagnetic transformer. An output of the piezoelectric transformer 301 is rectified and smoothed to a positive voltage by a rectifying and smoothing circuit. The rectifying and smoothing circuit is constituted by diodes D1 and D2 and a capacitor C2. An output voltage Vout_HVT of the piezoelectric transformer 301 is output from an output terminal 108 that is connected to a path extending from the piezoelectric transformer 301, and is supplied to loads (such as the primary transfer members 218). The output voltage Vout_HVT is divided by resistors R1 and R2, or the like and input into a non-inverting input terminal (+ terminal) of an operational amplifier 309. On the other hand, an analog signal (a control signal Vcont that is output from the CPU 105) is input from an input terminal 318 into an inverting input terminal (− terminal) of the operational amplifier 309 via a resistor R3. The operational amplifier 309, the resistor R3, and a capacitor C0 function as integration circuits. That is, the control signal Vcont that is smoothed according to an integral time constant that is defined depending on the component constant of the resistor R3 and the capacitor C0 is input into the operational amplifier 309. The output end of the operational amplifier 309 is connected to a voltage-controlled oscillator (VCO) 310. The voltage-controlled oscillator 310 is an example of an oscillator that variably sets the frequency of an output signal according to the input control signal. The output end of the voltage-controlled oscillator 310 is connected to the gate of a field-effect transistor 311. The field-effect transistor 311 is an example of a switching element that is driven by an output signal of the voltage-controlled oscillator 310. The drain of the field-effect transistor 311 is connected to a power supply (+24 V: Vcc) via an inductor L1, and is grounded via a capacitor C1. The inductor L1 is an element that is connected between the field-effect transistor 311 and the power supply Vcc, and is an example of an element including an inductance component to which a voltage is intermittently applied by the field-effect transistor 311 being driven. The drain of the field-effect transistor 311 is connected to one of primary side electrodes of the piezoelectric transformer 301. The other one of the primary side electrodes of the piezoelectric transformer 301 is grounded. The source of the field-effect transistor 311 is also grounded.

The voltage-controlled oscillator 310 switches the field-effect transistor 311 with the frequency according to the output voltage of the operational amplifier 309. The inductor L1 and the capacitor C1 form a resonance circuit. A voltage amplified by this resonance circuit is supplied to the primary side of the piezoelectric transformer 301. Accordingly, the piezoelectric transformer 301 is connected to a connection point between the switching element and the element including an inductance component, and outputs the maximum voltage upon application of a signal that oscillates with a predetermined resonance frequency. The voltage-controlled oscillator 310 operates such that an output frequency is increased with an increase in an input voltage and the output frequency is decreased with a decrease in the input voltage. When the output voltage Vout_HVT is increased, an input voltage Vsns_HVT of the non-inverting input terminal (+ terminal) of the operational amplifier 309 is also increased via the resistor R1, resulting in an increase in the voltage at the output terminal of the operational amplifier 309. That is, since an input voltage of the voltage-controlled oscillator 310 is increased, a driving frequency of the piezoelectric transformer 301 is also increased. In a frequency range that is higher than the resonance frequency, the piezoelectric transformer 301 decreases the output voltage when the driving frequency is increased. That is, the circuit shown in FIG. 3 configures a negative feedback control circuit. This negative feedback control circuit is an example of a feedback control mechanism for keeping a voltage that is output from the piezoelectric transformer 301 constant. When the output voltage Vout_HVT is decreased, the input voltage Vsns_HVT of the operational amplifier 309 is also decreased, resulting in a decrease in a voltage at the output terminal of the operational amplifier 309. As a result, the output frequency of the voltage-controlled oscillator 310 is also decreased, and negative feedback control is executed in the direction in which the output voltage of the piezoelectric transformer 301 is increased. Accordingly, the output voltage Vout_HVT is controlled so as to be equal to a target voltage determined by the control signal Vcont that is input from the CPU 105 into the inverting input terminal (− terminal) of the operational amplifier 309.

Figure 1:
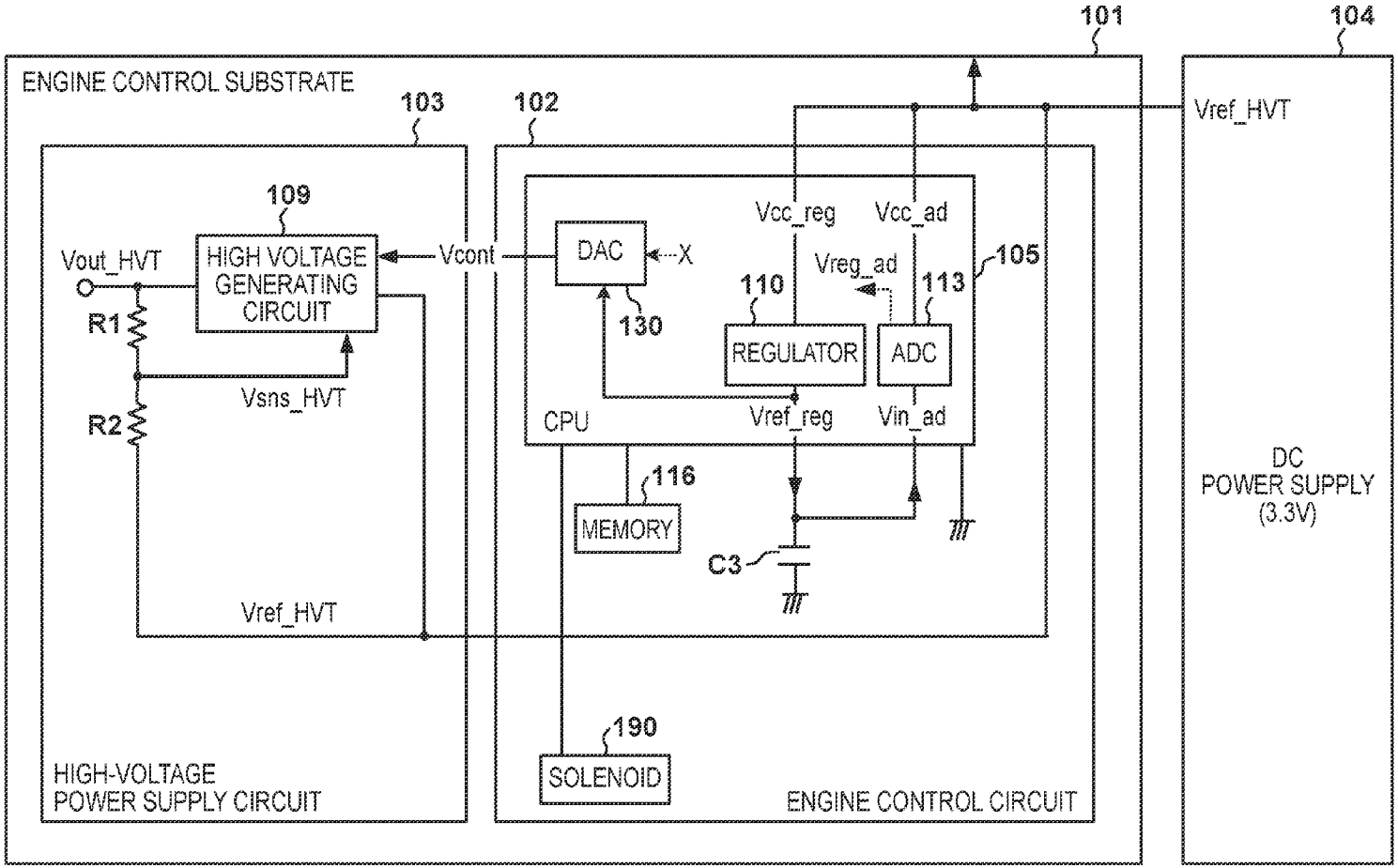
FIG. 1 is a diagram showing a control system.

FIG. 1 is a diagram illustrating a system configuration of Embodiment 1. An engine control substrate 101 includes an engine control circuit 102 and the high-voltage power supply circuit 103. The engine control circuit 102 configures a part of the above-described engine controller 206. A direct current (DC) power supply 104 supplies a DC voltage (3.3V) to the engine control substrate 101. The engine control circuit 102 includes the CPU 105, a nonvolatile memory 116, and the like. The high-voltage power supply circuit 103 outputs the output voltage Vout_HVT, based on the control signal Vcont that corresponds to a set value X from the CPU 105 and a high reference voltage Vref_HVT. The CPU 105 outputs the control signal Vcont to a high voltage generating circuit 109.

A regulator 110 functions as a generation unit for generating, upon being supplied with a regulator driving voltage Vcc_reg as a first reference voltage from the DC power supply 104, an output voltage Vref_reg, which serves as a second reference voltage. That is, the regulator 110 is a constant-voltage source for generating a constant output voltage Vref_reg irrespective of the regulator driving voltage Vcc_reg. Here, the regulator driving voltage Vcc_reg is the voltage Vref_HVT that is supplied from the DC power supply 104. The regulator output voltage Vref_reg drives a DA converter 130, which is a circuit provided inside the CPU 105, and is output to the outside of the CPU 105. A capacitor C3 is connected to the output terminal of the regulator output voltage Vref_reg in order to stabilize the regulator output voltage Vref_reg. On the other hand, the regulator output voltage Vref_reg is input into an AD converter 113 as an input voltage Vin_ad. The voltage accuracy of the regulator output voltage Vref_reg is assumed to be high, that is, about ±1%.

The AD converter 113 converts the input voltage Vin_ad into a digital value Vreg_ad by performing comparison operation between a driving voltage Vcc_ad and the input voltage Vin_ad. For example, assuming that the AD converter 113 is a 10-bit AD converter, the digital value Vreg_ad is calculated as follows:

$$V\text{reg_ad}=(V\text{in_ad}/V\text{cc_ad})*1023 \quad (1)$$

Where the driving voltage Vcc_ad is the voltage Vref_HVT of the DC power supply 104. The driving voltage Vcc_ad is used as a reference voltage on the high side of the AD converter 113. The AD converter 113 is provided inside the CPU 105.

The memory 116 is a nonvolatile storage device for storing information on a high-voltage power supply at the time of manufacturing. The memory 116 is connected to the CPU 105, and the information on a high-voltage power supply is read from the CPU 105. The high voltage generating circuit 109 outputs the output voltage Vout_HVT based on the control signal Vcont from the CPU 105 and the high reference voltage Vref_HVT. Furthermore, the high voltage generating circuit 109 feeds back a detection voltage Vsns_HVT that is proportional to the output voltage Vout_HVT, and performs control such that the output voltage Vout_HVT is constant. The high reference voltage Vref_HVT is a voltage that serves as a reference for the output voltage Vout_HVT. The detection voltage Vsns_HVT is a voltage obtained by dividing the output voltage Vout_HVT using the resistors R1 and R2. The relationship between the high reference voltage Vref_HVT and the output voltage Vout_HVT is as follows:

$$V\text{out_}HVT=((R1+R2)/R2)*(V\text{sns_}HVT-V\text{ref_}HVT)+V\text{ref_}HVT \quad (2)$$

Where the high reference voltage Vref_HVT is a voltage supplied from the DC power supply 104. The DC power supply 104 is a circuit for supplying a DC voltage of 3.3 V to the engine control substrate 101. The output voltage of the DC power supply 104 is assumed to have an output tolerance of about ±5%.

As shown in FIG. 1, a voltage supplied from the DC power supply 104 is used in common as the driving voltage Vref_reg of the regulator 110, the driving voltage Vcc_ad of the AD converter 113, and the high reference voltage Vref_HVT. These voltages are collectively referred to as the high reference voltage Vref_HVT.

At the time of manufacturing the engine control substrate

The information on a high-voltage power supply is obtained by a measuring device at the time of factory shipment (at the time of manufacturing) of an image forming apparatus. The CPU 105 that has obtained the information on a high-voltage power supply from the measuring device writes it into the memory 116. At the time of factory shipment, an external power supply for measurement that serves as the DC power supply 104 is connected to the engine control substrate 101. Specifically, a first set value X1*a*, a second set value X2*a*, a first measurement value V1*d*, a second measurement value V2*d*, and a comparison result Vreg_ad_ref between the high reference voltage Vref_HVT and the regulator output voltage Vref_reg are stored. The set value X is a set value for outputting a specific output voltage Vout_HVT, and the DA converter 130 generates and outputs the control signal Vcont of a voltage that corresponds to this set value. That is, the DA converter 130 functions as a setting unit for setting a high-voltage set value for the high voltage generating circuit 109. Furthermore, the high voltage generating circuit 109 functions as a generation unit for generating a high voltage based on the set value set by the DA converter 130 and the first reference voltage supplied from the DC power supply 104. The first measurement value V1*d* is an actually measured voltage obtained by setting the first set value X1*a* for the DA converter 130. For example, the output voltage Vout_HVT is converted by a fixture into the first measurement value V1*d*, which is 16-bit data. If the output voltage Vout_HVT is 1000 [V], the first measurement value V1*d* will be 0416h. The second measurement value V2*d* is an actually measured voltage obtained by setting the second set value X2*a* for the DA converter 130. The comparison result Vreg_ad_ref between the high reference voltage Vref_HVT and the regulator output voltage Vref_reg is a digital value that is output by inputting the regulator output voltage Vref_reg into the AD converter 113.

$$V\text{reg_ad_ref}=(V\text{ref_reg}/V\text{ref_}HVT)*1023 \quad (3)$$

At the time of mounting the engine control substrate

Correction of an output voltage that is performed when the engine control substrate 101 is mounted in the image forming apparatus 201 will be described. The DC power supply 104 that is mounted in the image forming apparatus 201 is connected to the engine control substrate 101. The AD converter 113 compares the high reference voltage Vref_HVT supplied from the DC power supply 104 of the image forming apparatus 201 with the regulator output voltage Vref_reg, and outputs a comparison result Vreg_ad_real. The comparison result Vreg_ad_real is a digital value obtained when the regulator output voltage Vref_reg is input into the AD converter 113.

$$V\text{reg_ad_real}=(V\text{ref_reg}/V\text{ref_}HVT)*1023 \quad (4)$$

The DC power supply 104 that is connected to the engine control substrate 101 is an external power supply for measurement at the time of factory shipment, and the DC power supply mounted on the image forming apparatus 201 after the engine control substrate 101 is mounted in the image forming apparatus 201. Therefore, the value of the high reference voltage Vref_HVT varies between at the time of manufacturing of the engine control substrate 101 and after it is mounted in the image forming apparatus 201. The CPU 105 corrects the set value based on the information on a high-voltage power supply stored in the memory 116 and the comparison result Vreg_ad_real obtained after the engine control substrate 101 is mounted. The detailed calculation method will be described later.

Figure 4:
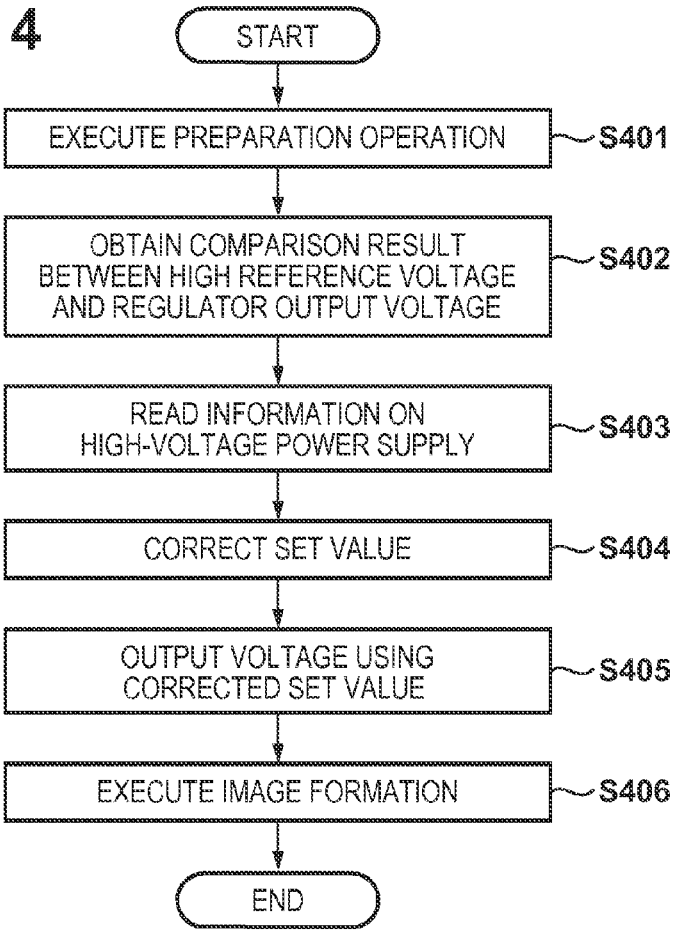
FIG. 4 is a flowchart of processing for correcting a high-voltage set value.

FIG. 4 is a flowchart showing processing for correcting a set value that is executed at the time of image formation. In step S401, the CPU 105 of the engine controller 206 starts a preparation operation upon receiving a print start command from the controller 204. The preparation operation refers to an operation in which rotation of the rotating polygonal mirror 207 of the scanner unit 210 is started, and temperature adjustment of the fixing device 224 is started, for example. In step S402, the CPU 105 obtains the comparison result Vreg_ad_real between the high reference voltage Vref_HVT and the regulator output voltage Vref_reg from the AD converter 113. In step S403, the CPU 105 reads information on a high-voltage power supply from the memory 116. In step S404, the CPU 105 determines a set value after correction based on the comparison result Vreg_ad_real, the information on a high-voltage power supply, and the set value X that is currently intended to be set. The information on a high-voltage power supply includes the comparison result Vreg_ad_ref obtained at the time of factory shipment. In step S405, the CPU 105 sets the corrected set value X for the DA converter 130. Accordingly, a desired output voltage can be obtained. In step S406, the CPU 105 outputs a /TOP signal to the controller 204 and starts outputting a video signal, thereby starting image formation.

Method for Correcting a Set Value

The method for correcting a set value in step S404 will be described in detail. Note that the calculation that will be described below is executed by a calculation processing unit such as the CPU 105.

Figure 5:
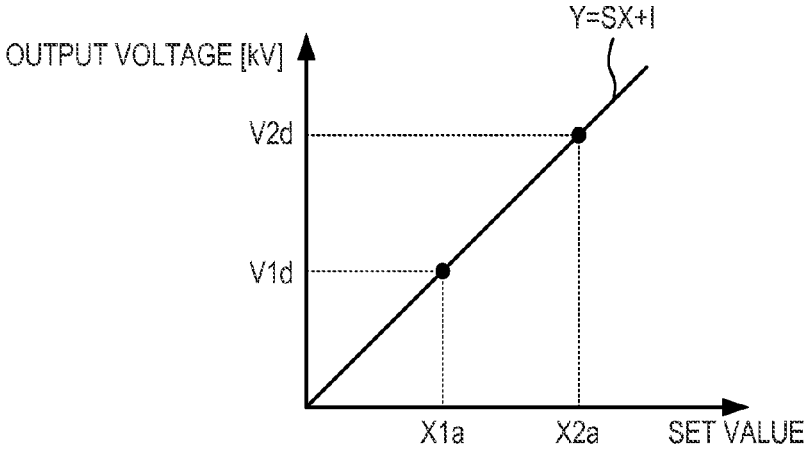
FIG. 5 is a diagram showing an example of data that is stored in a memory, specifically, an example of the relationship between the set value and the output voltage.

FIG. 5 is a diagram showing an example of a relationship between the set value and the output voltage. The vertical axis indicates the output voltages. The horizontal axis indicates the set values. In this example, the set values and the output voltages are in the linear relationship. As described above, the first measurement value V1*d* is an output voltage actually measured when the first set value X1*a* is set for the DA converter 130. The second measurement value V2*d* is an output voltage actually measured when the second set value X2*a* is set for the DA converter 130. The characteristic formula indicating the relationship between the output voltage and the set value is as follows:

$$Y=SX+I \tag{5}$$

$$\text{Slope } S=(V2d-V1d)/(X2a-X1a) \tag{6}$$

$$\text{Intercept } I=V2d-X2a\times S=V2d-X2a\times\{(V2d-V1d)/(X2a-X1a)\} \tag{7}$$

Where Y is the output voltage Vout_HVT. X is a set value.

In the above-described step S402, the comparison result Vreg_ad_real between the high reference voltage Vref_HVT and the regulator output voltage Vref_reg can be obtained according to the formula (4). It is assumed that a correction coefficient F is a ratio of the reference voltages.

$$F=V\text{reg_ad_ref}/V\text{reg_ad_real} \tag{8}$$

A desired output voltage E can be obtained by multiplying the characteristic formula (5) by the correction coefficient F.

$$E=F\times(SX+I) \tag{9}$$

The formula (9) is modified to calculate the set value X after correction.

$$X=(E/S)\times(1/F)-(I/S) \tag{10}$$

Accordingly, by storing, in the memory 116, the comparison result Vreg_ad_ref, the measurement values V1*d* and V2*d*, and the set values X1*a* and X2*a* as information on a high-voltage power supply, it is possible to correct the set value X. Note that the memory 116 may also have stored the comparison result Vreg_ad_ref, the slope S, and the intercept I. In this case, the number of stored variables can be reduced. Note that design target values V1*t* and V2*t* that correspond to X1*a* and X2*a* are also stored in the memory 116. The desired output voltage E in the formula (10) is substituted by V1*t* and V2*t*. Note that X1*a* is a design standard value that is needed for obtaining the desired output voltage V1*t*. X2*a* is a design standard value that is needed for obtaining the desired output voltage V2*t*.

According to the present embodiment, information on a high-voltage power supply is obtained at the time of factory shipment, and the set value X is corrected using the information on a high-voltage power supply. Accordingly, the high output voltage Vout_HVT that has the same voltage accuracy as that of the regulator 110 can be obtained irrespective of the accuracy of the high reference voltage Vref_HVT. In the conventional technique, a variation in the high reference voltage Vref_HVT is not taken into consideration, and an accurate high reference voltage Vref_HVT is needed. That is, an accurate power supply integrated circuit (IC) is needed. On the other hand, in the present embodiment, the output voltage Vout_HVT that is accurate can be obtained with a relatively inexpensive configuration. Furthermore, a current hardly flows into the input section of the AD converter 113, and thus the regulator 110 does not need to have a high driving capacity. Furthermore, since the regulator 110 also serves as a power supply for driving the CPU 105, the present embodiment can be realized inexpensively.

Figure 6:
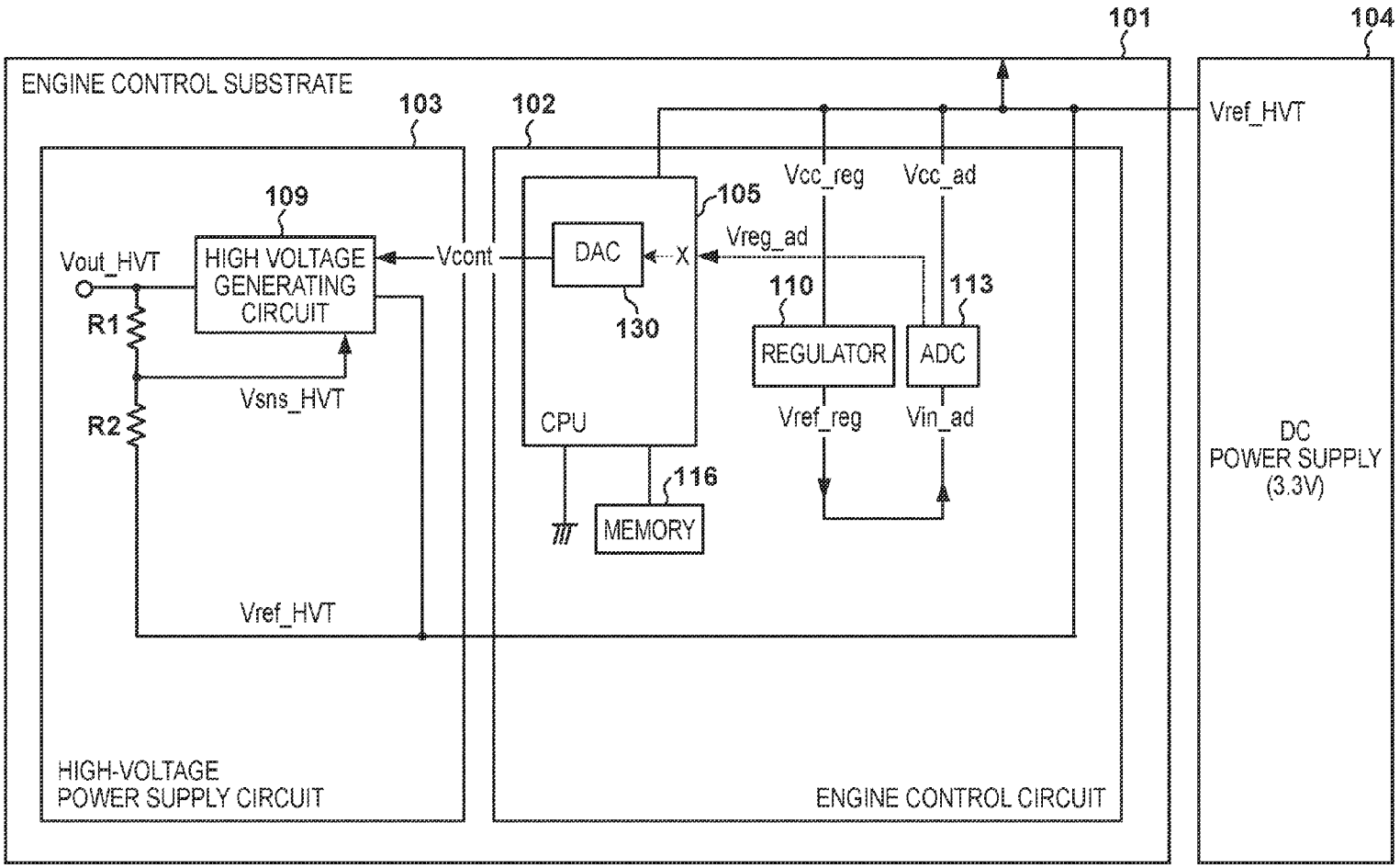
FIG. 6 is a diagram showing a control system.

Embodiment 1 has been described in which a set value of an output voltage is corrected using the regulator 110 and the AD converter 113 provided inside the CPU 105. However, the regulator 110 and the AD converter 113 do not necessarily provided inside the CPU 105. As shown in FIG. 6, both the regulator 110 and the AD converter 113 may be provided outside the CPU 105. Furthermore, one of the regulator 110 and the AD converter 113 may be provided inside the CPU 105, and the other one may be provided outside the CPU 105. The method for correcting a set value X that has been described in Embodiment 1 is applicable even when the positions at which the regulator 110 and the AD converter 113 are located are changed as described above, and Embodiment 2 has the same effects as those of Embodiment 1.

Accordingly, the DC power supply 104, which has a high driving capacity but has a low accuracy, can be combined with the power supply of the high voltage generating circuit 109, the regulator 110 that has a low driving capacity but has a high voltage accuracy, and the method for correcting a set value X. As a result, an accurate high voltage can be obtained by a relatively inexpensive configuration. An accurate voltage that is output by the regulator 110 may also be used as a reference voltage for another application, possibly lowering the manufacturing cost with respect to an entire system.

Figure 7:
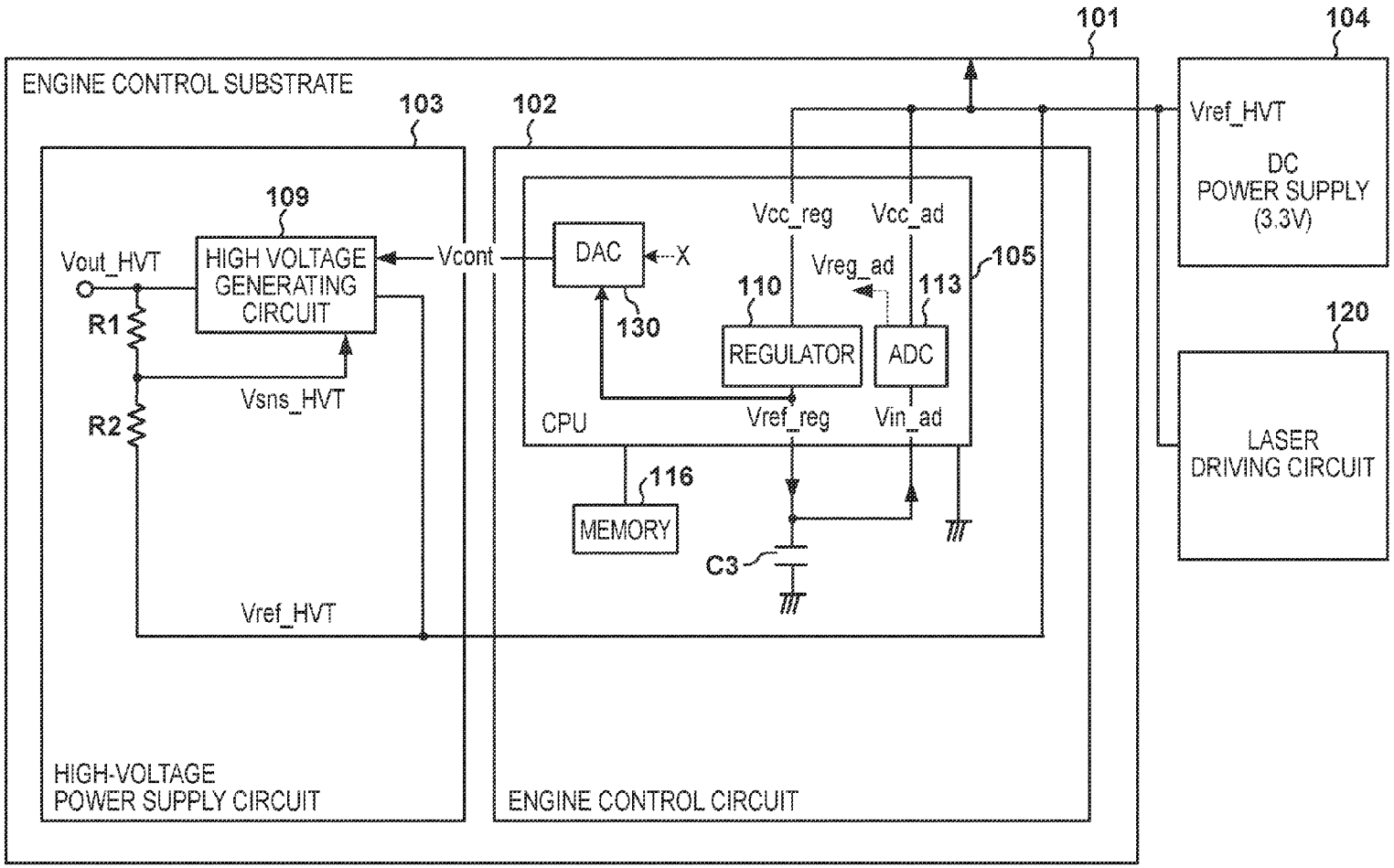
FIG. 7 is a diagram showing a control system.

FIG. 7 is a block diagram showing a system of Embodiment 3. Embodiment 3 relates to a method for determining a set value depending on the operational status of a plurality of light-emitting elements mounted on the scanner unit 210. The same reference numerals are given to the components that have already been described, and thereby descriptions thereof are simplified.

FIG. 7 differs from FIG. 1 in that a reference voltage Vref_HVT that is output by the DC power supply 104 is supplied to a laser driving circuit 120. Accordingly, a laser driving voltage as well is used in common as the high reference voltage Vref_HVT, the regulator driving voltage Vcc_reg, and the AD converter driving voltage Vcc_ad. Therefore, Embodiment 3 can realize a more inexpensive configuration than those of Embodiments 1 and 2. However, one power supply, instead of the plurality of power supplies, is used, there is the problem that the high reference voltage Vref_HVT drops depending on a laser output. If the high reference voltage Vref_HVT drops, the high output voltage Vout_HVT will vary as described in Embodiment 1. Accordingly, in Embodiment 3, a method for correcting a set value X taking into consideration a drop caused due to a laser output will be described. In the present embodiment, for the sake of description, it is assumed that the charging devices 216 and the developing devices 217 use the high reference voltage Vref_HVT as a power supply voltage. Each of the charging device 216 and the developing device 217 includes one high-voltage power supply circuit 103.

Figure 8:
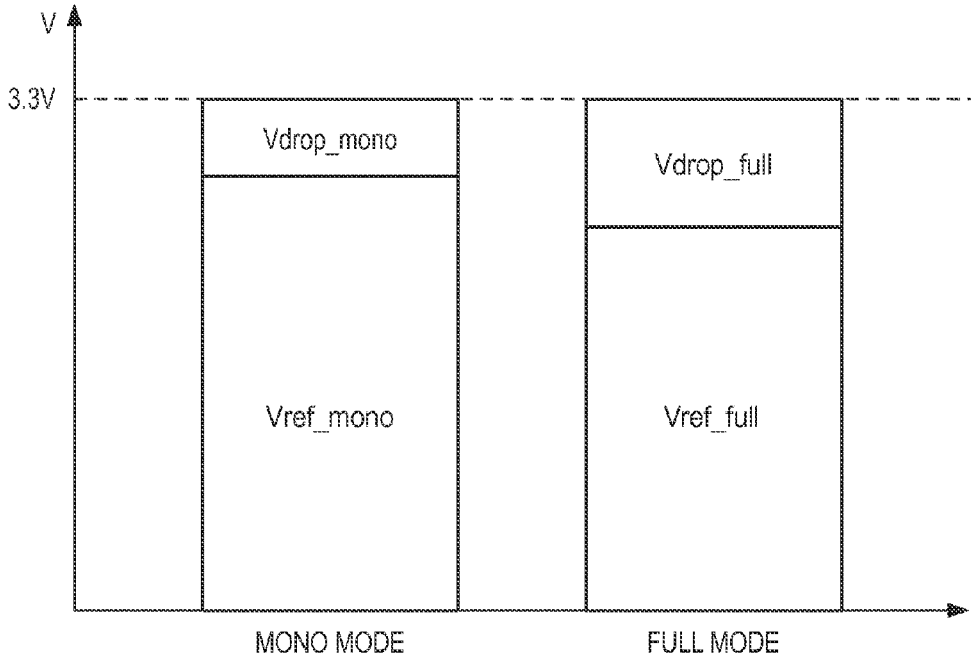
FIG. 8 is a diagram showing an example of voltage change in a monochrome mode and a multicolor mode.

FIG. 8 is a diagram schematically showing the voltage change in the time period in which the image forming apparatus has transitioned to a mono mode, and the voltage change in a full mode. The vertical axis indicates the voltages and the horizontal axis indicates the print modes. When the scanner unit starts laser light emission, the high reference voltage Vref_HVT decreases. The amount of drop increases with an increase in the number of operating lasers. Here, the mono mode refers to a mode in which an image is formed using only a black toner and only the black laser element emits light. The full mode refers to a mode in which an image is formed using all the toners of four colors and all the four lasers can emit light. Accordingly, the relationship between a voltage drop amount Vdrop in the mono mode and a voltage drop amount Vdrop' in the full mode is as follows:

$$V\text{drop_mono} < V\text{drop_full} \tag{11a}$$

As shown in FIG. 8, the voltages supplied as the high reference voltages Vref_HVT to the circuits by the DC power supply 104 have the following relationship. That is, the relationship between a high reference voltage Vref_mono in the mono mode and a high reference voltage Vref_full in the full mode is as follows:

$$V\text{ref_mono} > V\text{ref_full} \tag{11b}$$

That is, since the high reference voltage Vref_HVT varies depending on the print mode, the correction result of a set value described in Embodiment 1 also varies.

Figure 9:
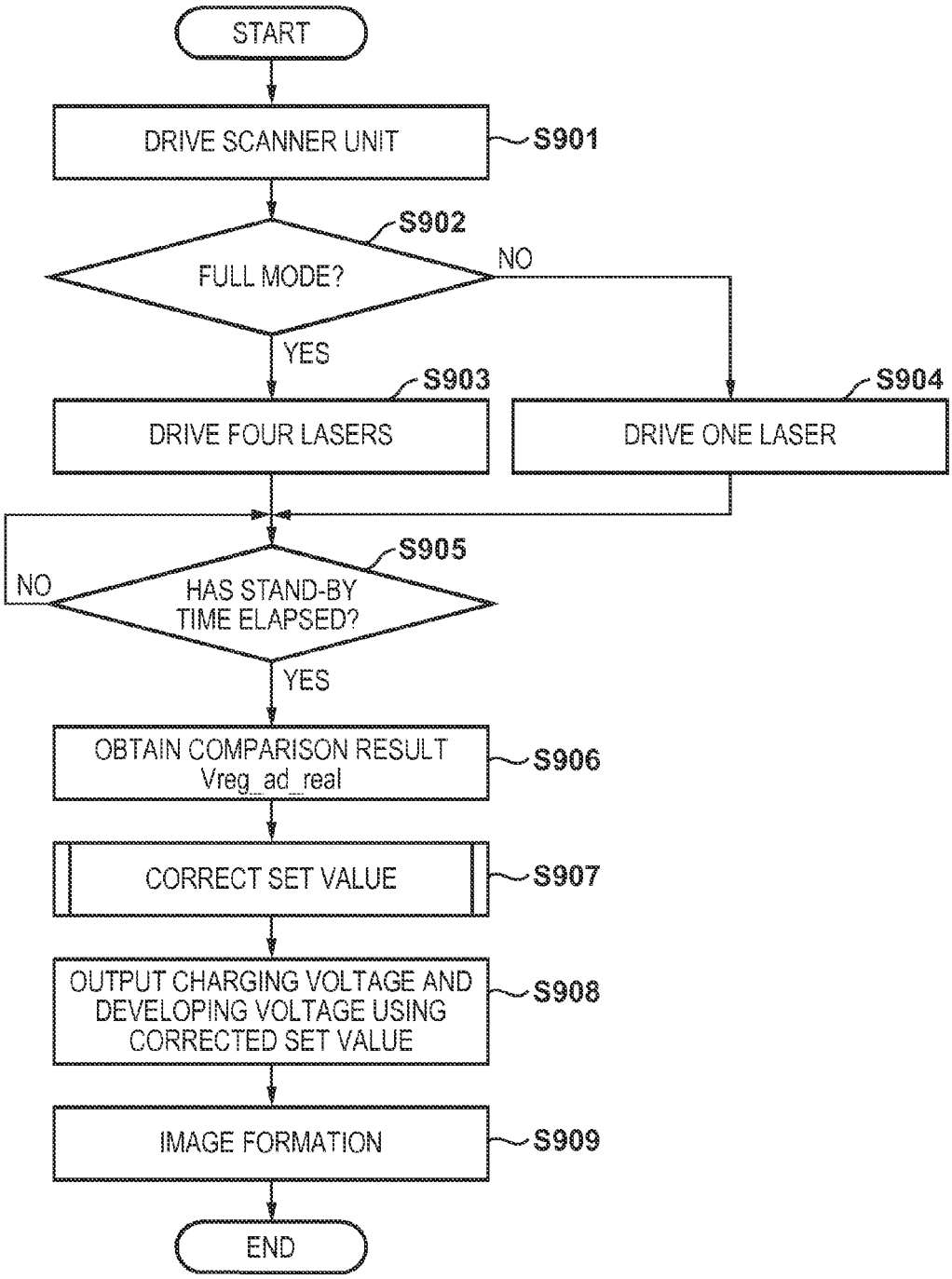
FIG. 9 is a flowchart of processing for correcting a high-voltage set value.

FIG. 9 is a flowchart showing a method for correcting a set value depending on the print mode. The CPU 105 starts processing indicated by the present flowchart upon receiving a print start command from the controller 204. In step S901, the CPU 105 drives, as a preliminary preparation of the printer, various types of motors including a motor for driving the scanner unit 210. In step S902, the CPU 105 determines whether or not the print mode designated by the controller 204 is the full mode. If the print mode is the full mode, the procedure advances to step S903. In step S903, the CPU 105 instructs the laser driving circuit 120 to let the four laser elements of the scanner unit 210 compulsorily emit light, and the procedure advances to step S905. On the other hand, if the print mode is the mono mode, the procedure advances to step S904. In step S904, the CPU 105 instructs the laser driving circuit 120 to let one of the four laser elements of the scanner unit 210, namely, the black laser element compulsorily emit light, and the procedure advances to step S905. The CPU 105 starts a timer at the start of the compulsory light emission.

In step S905, the CPU 105 determines whether or not the count value of the timer exceeds a predetermined stand-by time. This stand-by time is a processing time that is needed for AD conversion processing of the AD converter 113 and is 20 msec, for example. When the stand-by time has elapsed, the procedure advances to step S906. In step S906, the CPU 105 obtains the comparison result Vreg_ad_real from the AD converter 113.

In step S907, the CPU 105 corrects the set value X based on the comparison result Vreg_ad_real. That is, the comparison result Vreg_ad_real is used with respect to the set value X that corresponds to a predetermined charging voltage or developing voltage to correct the set value X in the same manner as in Embodiment 1. In order words, the correction coefficient F is calculated based on the comparison result Vreg_ad_real and the Vreg_ad_ref that is stored in the memory 116. Furthermore, the slope S and the intercept I are calculated by the same calculation as in Embodiment 1. The CPU 105 calculates the corrected set value X using the formula (10). The set value X is obtained for each of the charging voltage and the developing voltage. Furthermore, in step S908, the CPU 105 sets the set value X for the DA converter 130, and starts outputting the charging voltage and the developing voltage. Also, the DA converter 130 is provided for each of the charging voltage and the developing voltage. However, the regulator 110 and the AD converter 113 are shared. In step S909, the CPU 105 controls the image formation section to execute image formation.

According to Embodiment 3, thus, the CPU 105 lets at least one laser element compulsorily emit light depending on the print mode, monitors the amount of drop of the high reference voltage, and corrects the set value X according to the monitoring result. Even when the DC power supply 104 is used not only as a reference power supply of the high-voltage power supply circuit 103 but also as a reference power supply of another circuit (for example, the laser driving circuit 120), an appropriate set value X can be obtained. That is, even when the number of the laser elements in use is changed, it is possible to stabilize the output voltage of the high-voltage power supply circuit 103. According to Embodiment 3, it is possible to reduce the number of reference power supplies by a reference power supply being shared, and to stabilize the high output voltage even when a reference voltage of the reference power supply varies.

In Embodiment 3, the set value X is corrected at the start of image formation. That is, the correction is executed in the preparation time period of the image formation. Meanwhile, when a plurality of print jobs is processed successively, there is a case where the print mode is switched from the full mode to the mono mode, or from the mono mode to the full mode. In this case, since there is only one preparation time period, it is problematic when the correction processing is to be executed.

Figure 10A:
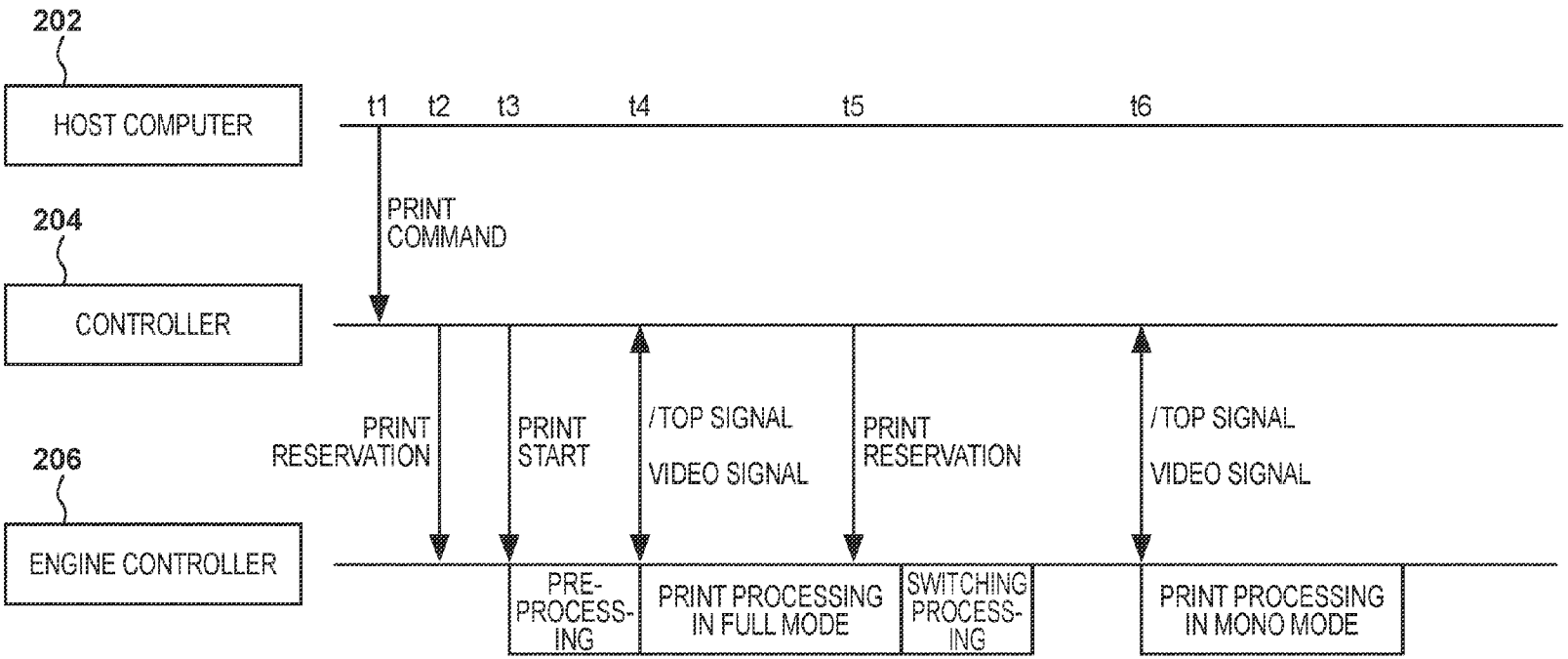
FIG. 10A is a timing chart illustrating processing for switching a print mode.
Figure 10B:
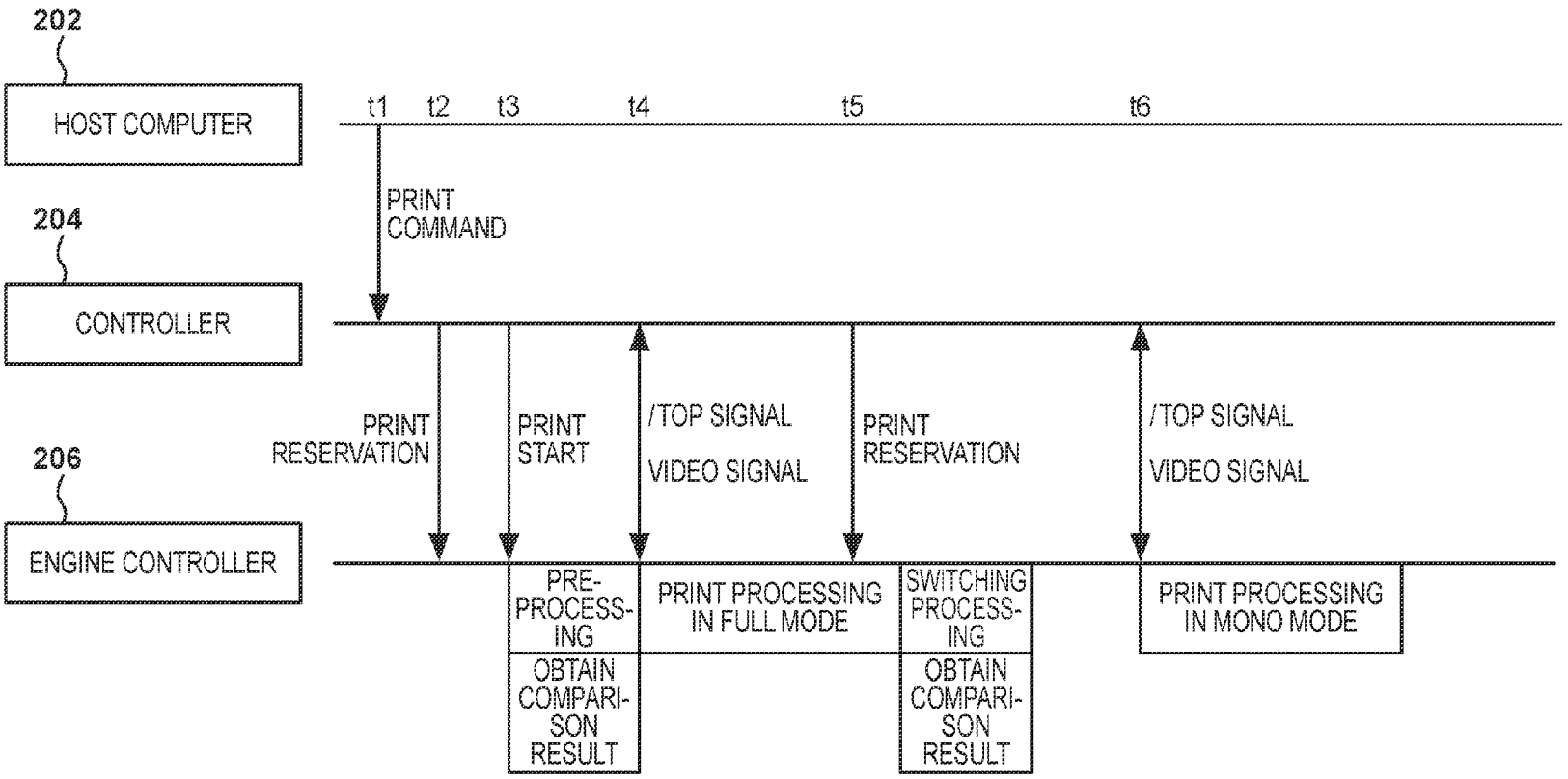
FIG. 10B is a timing chart illustrating a timing at which a comparison result is obtained.

FIG. 10A is a diagram illustrating exemplified processing for switching the print mode. FIG. 10B is a diagram showing a time at which a comparison result for use in executing correction processing is obtained according to Embodiment 4. As shown in FIG. 10A, at a time t1, the controller 204 receives a print command and image information from the host computer 202. At a time t2, the controller 204 transmits a print reservation command to the engine controller 206. At a time t3, the controller 204 transmits a print start command to the engine controller 206. Upon receiving the print start command at the time t3, the engine controller 206 starts preprocessing (preparation operation) for print. The preprocessing includes, for example, putting an actuator for driving the scanner unit 210 or various types of rollers in operation. The print reservation command includes information indicating whether a monochrome image or a color image is to be printed for each page. It is assumed here that a color image is to be printed for the first page. Therefore, the engine controller 206 sets the image formation section to the full mode and performs print processing. Here, the full mode refers to a state in which constituent components of the image forming apparatus 201 are driven so as to form toner images of a plurality of colors. At a time t4, when the preprocessing is completed, the engine controller 206 outputs a /TOP signal to the controller 204, receives a video signal, and executes print processing.

At a time t5 during printing in the full mode, the controller 204 transmits a print reservation command for the next image (monochrome image) to the engine controller 206. The engine controller 206 determines, upon receiving the print reservation command, whether or not the designated print mode is different from the current print mode. If they are different from each other, the engine controller 206 executes print mode switching processing. The switching processing refers to processing for changing the print mode of the image formation section from the full mode to the mono mode, or from the mono mode to the full mode. When the switching processing is completed, at a time t6, the engine controller 206 continues the image formation in the switched print mode.

As described above, when the switching processing is performed, the print mode is switched without preprocessing. Therefore, if it is premised that the correction processing is executed in the preprocessing, the charging voltage and the developing voltage will be output while the set value X is uncorrected in the switched print mode. Therefore, in Embodiment 4, as shown in FIG. 10B, the laser elements are driven during the switching processing to obtain the comparison result Vreg_ad_real. Accordingly, the output voltage Vout_HVT is controlled with accuracy also in the switched print mode.

Figure 11A:
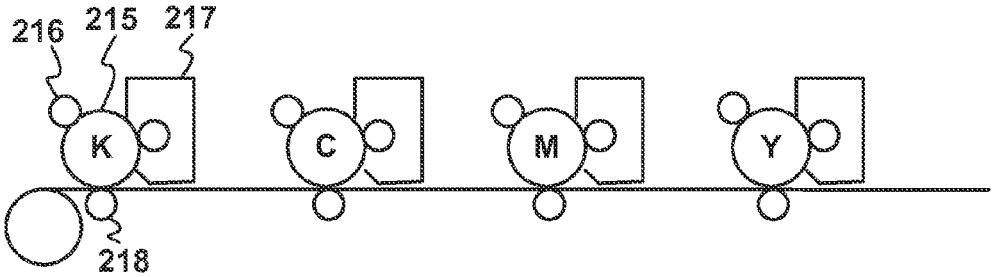
FIG. 11A is a diagram showing the contact state between photoreceptors and developing devices in a full mode.
Figure 11B:
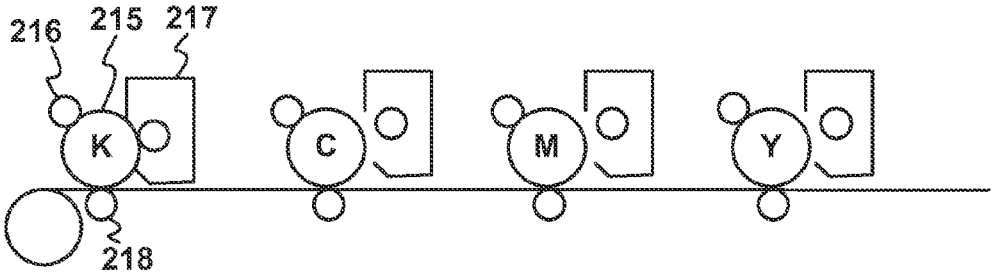
FIG. 11B is a diagram showing the contact state between the photoreceptors and the developing devices in a mono mode.
Figure 11C:
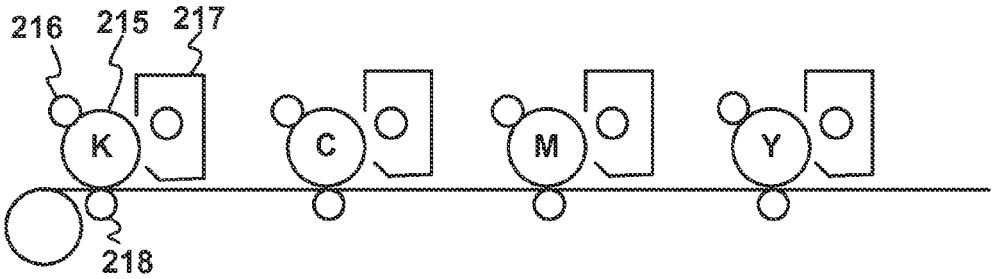
FIG. 11C is a diagram showing the contact state between the photoreceptors and the developing devices in a stand-by mode.

FIG. 11A shows the positional relationship between the developing devices 217 and the photoreceptors 215 in the full mode. In the full mode, the developing devices 217 and the photoreceptors 215 of all of the four YMCK stations are respectively in contact with each other. FIG. 11B shows the positional relationship between the developing devices 217 and the photoreceptors 215 in the mono mode. In the mono mode, only the developing device 217 for black is in contact with the corresponding photoreceptor 215. FIG. 11C shows the positional relationship between the developing devices 217 and the photoreceptors 215 in the stand-by mode. In the stand-by mode, the developing devices 217 and the photoreceptors 215 of all of the four YMCK stations are respectively moved away from each other. The above-described preparation time period corresponds to the stand-by mode. In the stand-by mode, even when the laser element emits light, no toner image is formed on the intermediate transfer belt 219. This is because even when an electrostatic latent image is formed, development by the toner image is not executed.

The three contact states shown in FIGS. 11A to 11C are switched only in a specific order. That is, the contact states are switched only in the order of, for example, (i) stand-by mode, (ii) full mode, (iii) mono mode, and (i) stand-by mode. Direct transition from the stand-by mode to the mono mode is impossible, and direct transition from the mono mode to the full mode is also impossible. This is because of the mechanical limitation of the switching mechanism. Note that a certain transition time is needed for transition between the states. The transition time is, for example, 500 msec.

Figure 12A:
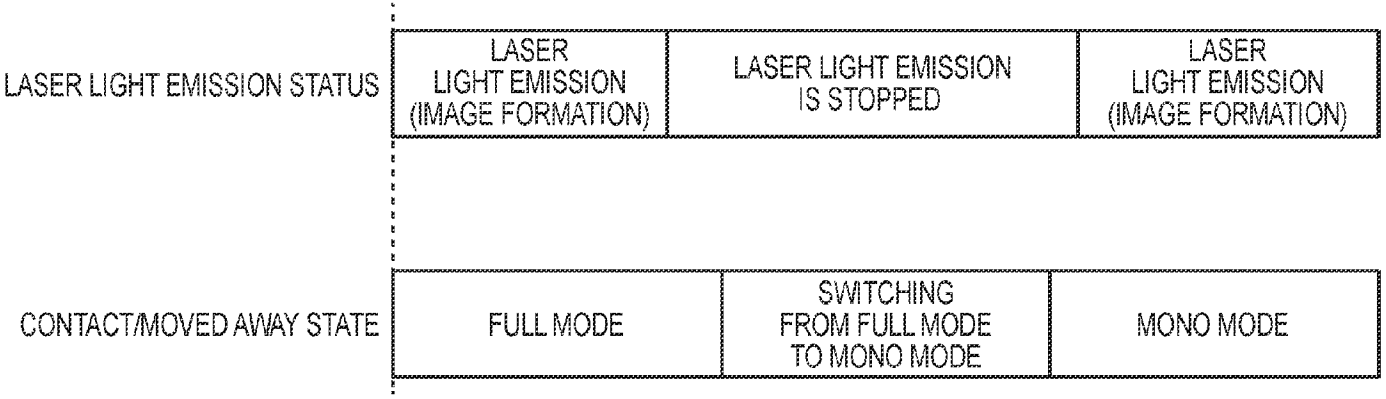
FIG. 12A is a timing chart showing switching processing from the full mode to the mono mode.

FIG. 12A shows the contact states of the developing devices 217 and the laser light emission statuses when switching from the full mode to the mono mode is performed. In the full mode, the four developing devices 217 are respectively in contact with the respective photoreceptors 215, and the four laser elements respectively emit light based on video signals. Then, the engine controller 206 starts the switching processing. The CPU 105 of the engine controller 206 drives the solenoid 190 to transition the contact state of the developing devices 217 from the full mode to the mono mode. When the contact state becomes the mono mode, the engine controller 206 performs image formation in the mono mode. Accordingly, the switching processing from the full mode to the mono mode is performed not via the stand-by mode. Therefore, in this state, it is not possible to perform compulsory light emission for obtaining a comparison result.

Figure 12B:
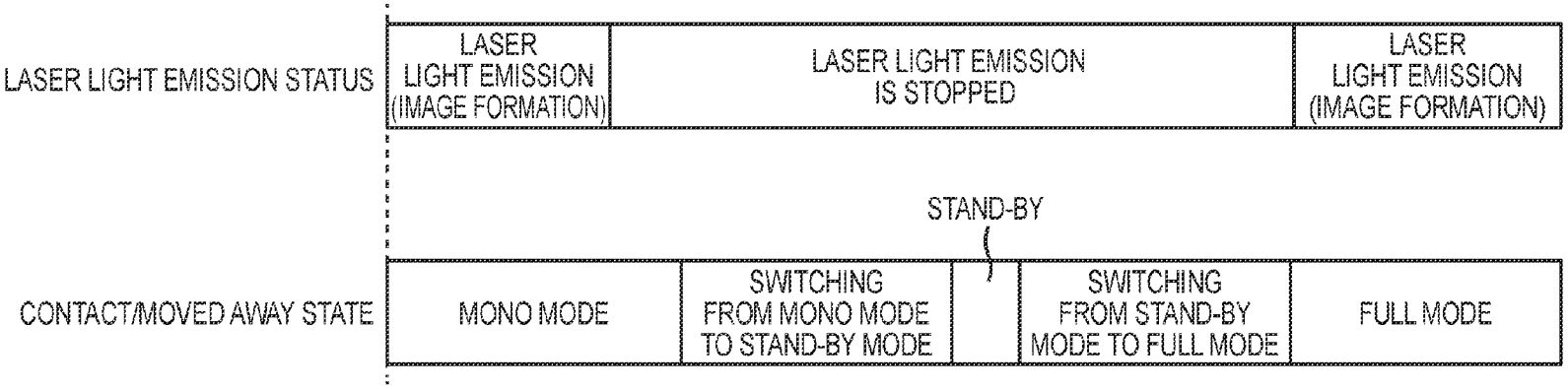
FIG. 12B is a timing chart showing switching processing from the mono mode to the full mode.

FIG. 12B shows the contact states of the developing devices 217 and the laser light emission statuses when switching from the mono mode to the full mode is performed. When the image formation in the mono mode is completed, the engine controller 206 stops light emission of the laser element, and drives the solenoid 190 to transition the contact state of the developing devices 217 from the mono mode to the stand-by mode. When the four developing devices 217 have transitioned to the moved-away mode (stand-by mode), the engine controller 206 drives the solenoid 190 again. Accordingly, the contact state transitions from the stand-by mode to the full mode. Then, the engine controller 206 starts image formation in the full mode. Accordingly, the switching processing from the mono mode to the full mode is performed via the stand-by mode. Therefore, it is possible to perform compulsory light emission for obtaining a comparison result in the stand-by mode.

Figure 13A:
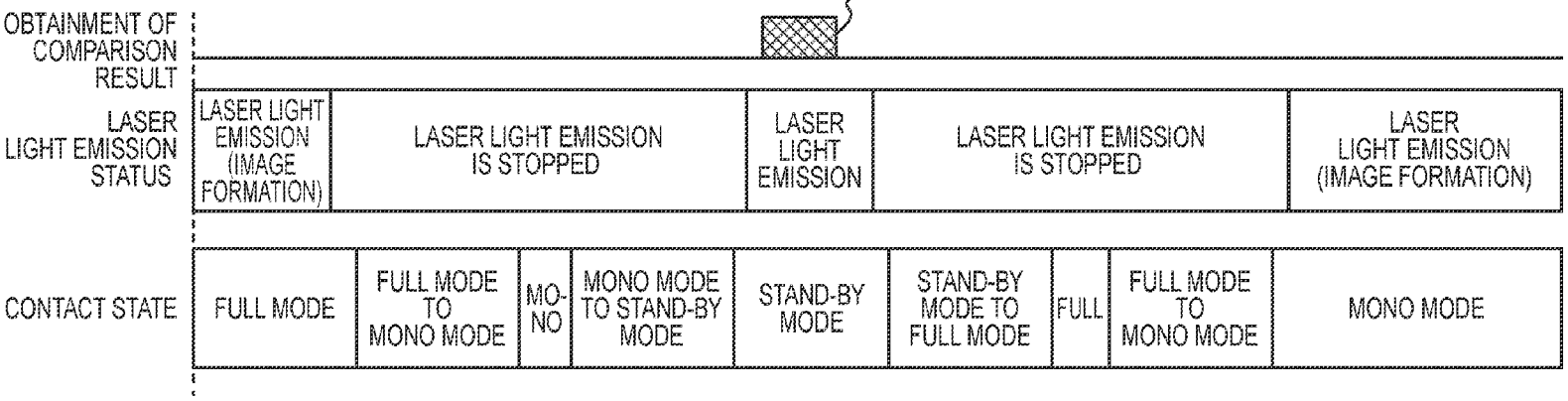
FIG. 13A is a timing chart illustrating a timing at which a comparison result is obtained when switching from the full mode to the mono mode is performed.
Figure 13B:
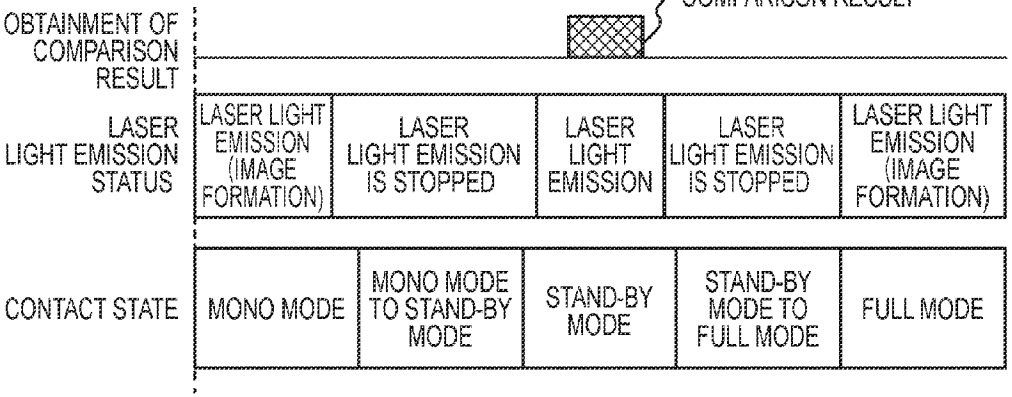
FIG. 13B is a timing chart illustrating a timing at which a comparison result is obtained when switching from the mono mode to the full mode is performed.

FIG. 13A is a timing chart showing the laser light emission status, the contact state of the developing devices 217, and a timing at which the comparison result Vreg_ad_real is obtained when switching from the full mode to the mono mode is performed. As described with reference to FIG. 12A, the switching from the full mode to the mono mode is performed not via the stand-by mode. Therefore, switching is performed from the full mode to the mono mode, then from the mono mode to the full mode via the stand-by mode, and then from the full mode to the mono mode. Although the switching process is complicated, switching from the full mode to the mono mode can be performed via the stand-by mode, thus making it possible to execute compulsory light emission for obtaining a comparison result. FIG. 13B is a timing chart when switching from the mono mode to the full mode is performed. As described with reference to FIG. 12B, switching from the mono mode to the full mode is performed via the stand-by mode. Therefore, in the stand-by mode, the CPU 105 lets the laser elements compulsorily emit light, obtains the comparison result Vreg_ad_real, and corrects the set value X.

Figure 14:
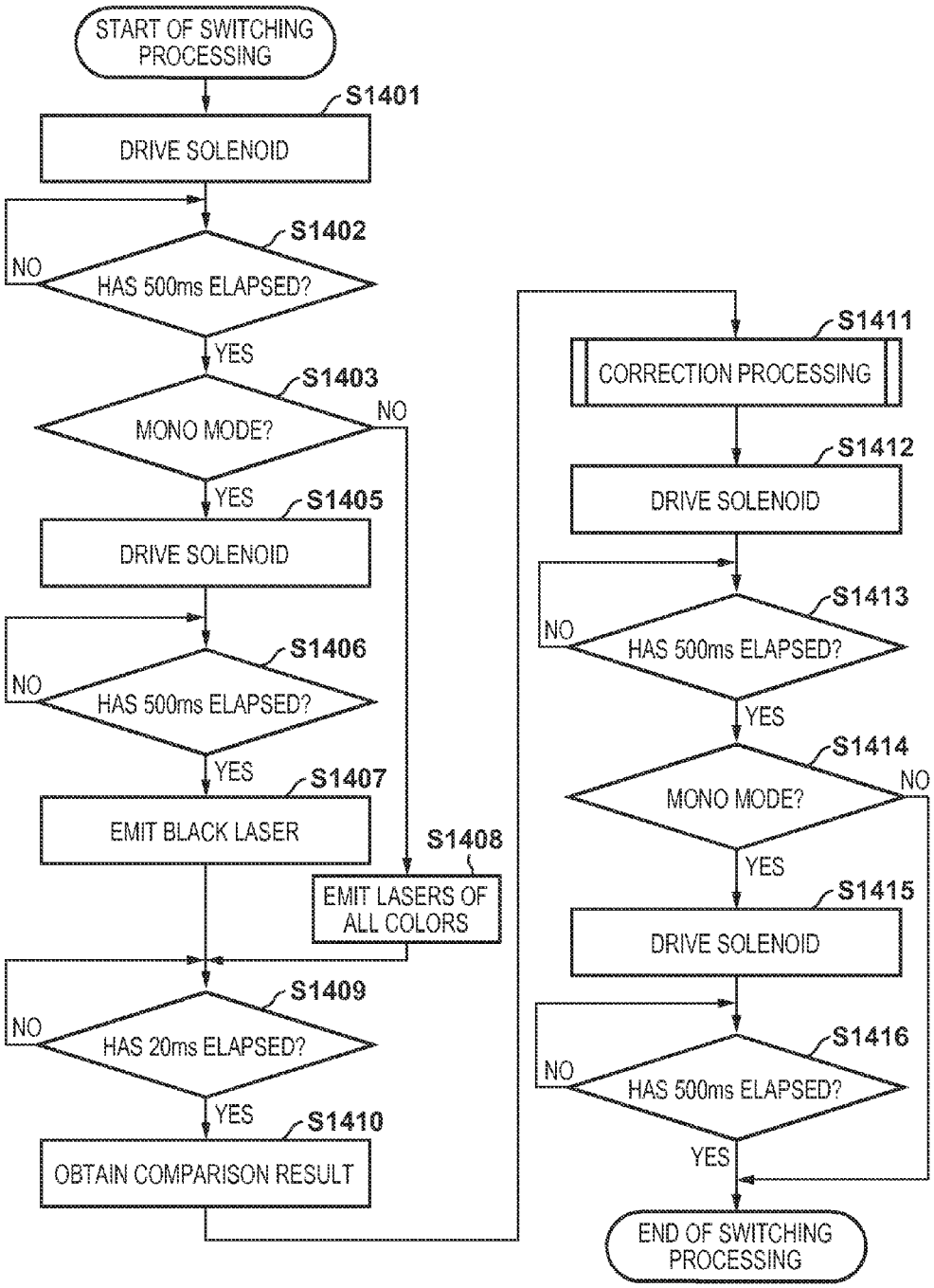
FIG. 14 is a flowchart of processing for obtaining a comparison result.

FIG. 14 is a flowchart showing set value correcting processing in the switching processing. In step S1401, the CPU 105 drives the solenoid 190 and starts a timer. In step S1402, the CPU 105 obtains a count time of the timer to determine whether or not a predetermined stand-by time has elapsed since the solenoid 190 was driven. The stand-by time is, for example, 500 msec. If the stand-by time has elapsed, the procedure advances to step S1403. In step S1403, the CPU 105 determines whether or not the mode after switching is the mono mode. If the mode after switching is not the mono mode but the full mode, switching from the mono mode to the full mode has been executed. In this case, since the switching has been executed via the stand-by mode, it is possible to obtain the comparison result Vreg_ad_real in the stand-by mode. The procedure thus advances to step S1408. In step S1408, the CPU 105 lets the laser elements for all the colors compulsorily emit light. As described above, the AD converter 113 generates the comparison result Vreg_ad_real. Then, the procedure advances to step S1409.

If it is determined in step S1403 that the mode after switching is the mono mode, the switching from the full mode to the mono mode has been executed. Therefore, the switching has been executed ordinarily not via the stand-by mode. The procedure thus advances to step S1405. In step S1405, the CPU 105 drives the solenoid 190 in order to execute switching from the mono mode to the full mode, and starts a timer. Therefore, the switching will be performed via the stand-by mode. In step S1406, the CPU 105 obtains a count time of the timer to determine whether or not a predetermined stand-by time has elapsed since the solenoid 190 was driven. If the stand-by time has elapsed, the procedure advances to step S1407. When the stand-by time has elapsed, the developing device 217 has transitioned to a moved away state. In step S1407, the CPU 105 lets the black laser element compulsorily emit light. As described above, the AD converter 113 generates the comparison result Vreg_ad_real. Then, the procedure advances to step S1409.

In step S1409, the CPU 105 counts a time using the timer, and determines whether or not a stand-by time (for example, 20 msec) necessary for AD conversion processing of the AD converter 113 has elapsed. When the AD conversion processing has been completed, the procedure advances to step S1410. In step S1410, the CPU 105 obtains the comparison result Vreg_ad_real from the AD converter 113.

In step S1411, the CPU 105 executes the processing for correcting a set value X described in Embodiments 1 to 3. In step S1412, the CPU 105 drives the solenoid 190 in order to transition the developing devices 217 from the stand-by mode to the full mode, and starts a timer. In step S1413, the CPU 105 obtains a count time of the timer to determine whether or not a predetermined stand-by time has elapsed since the solenoid 190 was driven. If the stand-by time has elapsed, the procedure advances to step S1414. In step S1414, the CPU 105 determines whether or not the eventual mode designated by the controller 204 is the mono mode. If the eventual mode designated by the controller 204 is the full mode, the CPU 105 ends the processing since no further mode switching is necessary. On the other hand, if the eventual mode is the mono mode, further switching is necessary and thus the procedure advances to step S1415. In step S1415, the CPU 105 drives the solenoid 190 in order to transition the developing devices 217 from the full mode to the mono mode, and starts a timer. In step S1416, the CPU 105 obtains a count time of the timer to determine whether or not a predetermined stand-by time has elapsed since the solenoid 190 was driven. If the stand-by time has elapsed, the switching processing ends.

As described above, according to Embodiment 4, the CPU 105 corrects a set value X not only in the preprocessing but also in the print mode switching processing. Therefore, even when the print mode switching processing is provided therebetween, it is possible to maintain an output voltage of the high-voltage power supply circuit 103 with accuracy.

Embodiment 1 has described assuming that the first set value X1*a*, which is a standard value for obtaining the desired output voltage V1*t*, and the second set value X1*a*, which is a standard value for obtaining the desired output voltage V2*t*, are stored in the memory 116. However, a first set value X1*b*, which is actually needed for obtaining the output voltage V1*t*, and a second set value X2*b*, which is actually needed for obtaining the output voltage V2*t*, may be obtained at the time of factory shipment by performing a test, and stored in the memory 116.

Figure 15:
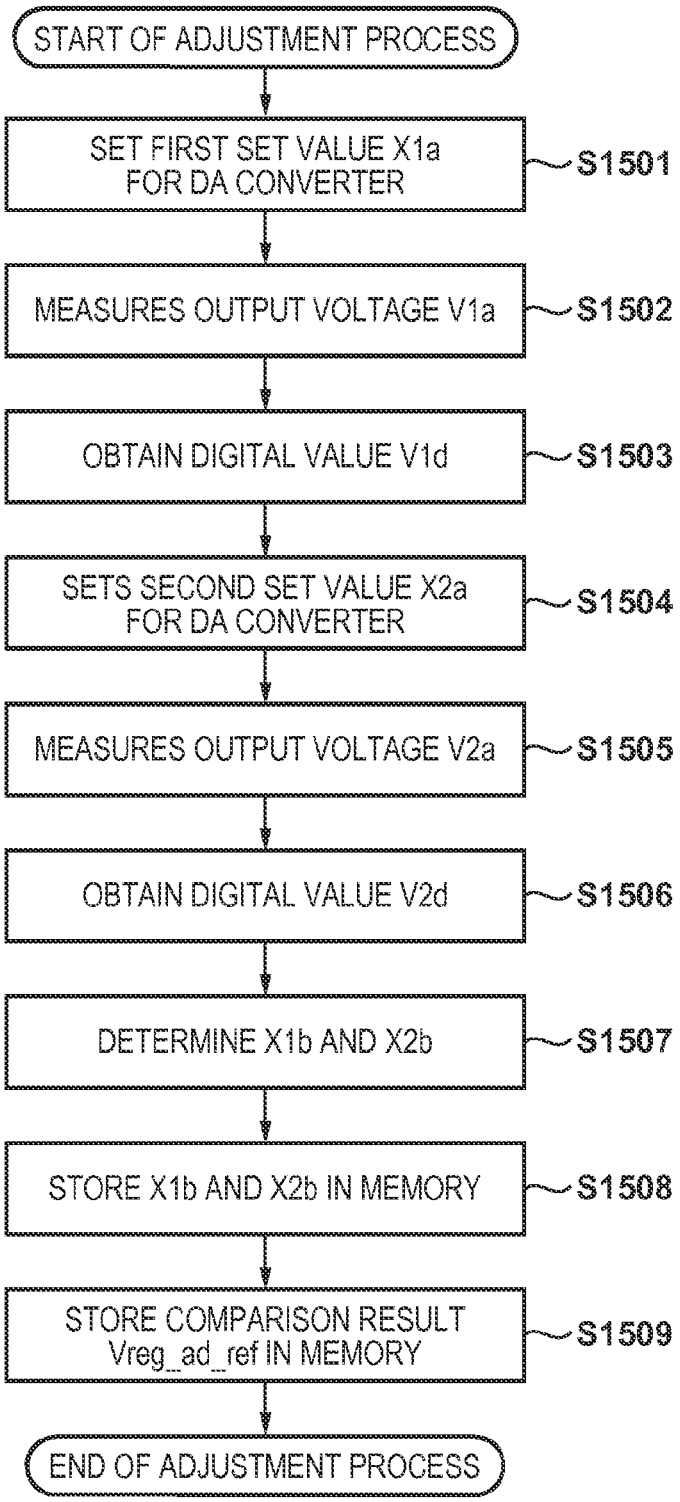
FIG. 15 is a flowchart of processing for obtaining power supply information in a manufacturing process.

FIG. 15 is a flowchart showing an adjustment process that is executed at the time of factory shipment in Embodiment 5. It is here assumed that an external power supply for measurement that serves as the DC power supply 104 is connected to the engine control substrate 101. The reference voltage supplied from the DC power supply 104 is defined as a Vreg1.

In step S1501, the CPU 105 sets the first set value X1*a*, which is a design standard value for outputting the output voltage V1*t*, for the DA converter 130. In step S1502, the CPU 105 stands-by until the output voltage Vout_HVT is stabilized, and then measures a measurement value Via of the output voltage Vout_HVT using a measuring device. In step S1503, the CPU 105 converts the measurement value Via into the digital value V1*d*, which is a 16-bit integer.

In step S1504, the CPU 105 sets the second set value X2*a*, which is a design standard value for outputting the output voltage V2*t*, for the DA converter 130. In step S1505, the CPU 105 stands-by until the output voltage Vout_HVT is stabilized, and then measures a measurement value V2*a* of the output voltage Vout_HVT using the measuring device. In step S1506, the CPU 105 converts the measurement value V2*a* into the digital value V2*d*, which is a 16-bit integer.

In step S1507, the CPU 105 determines, based on the digital values V1*d* and V2*d*, the set value X1*b* for obtaining the desired output voltage V1*t* when the reference voltage supplied from the DC power supply 104 is Vreg1. Similarly, the CPU 105 determines, based on the digital values V1*d* and V2*d*, the set value X2*b* for obtaining the desired output voltage V2*t* when the reference voltage supplied from the DC power supply 104 is Vreg1. In step S1508, the CPU 105 stores the set values X1*b* and X2*b* in the memory 116. In step S1509, the CPU 105 obtains the comparison result Vreg_ad_ref from the AD converter 113 and stores the obtained comparison result Vreg_ad_ref in the memory 116.

Hereinafter, a method for determining the set values X1*b* and X2*b* will be described in detail. As shown in FIG. 1 and the like, the high-voltage power supply circuit 103 is constituted by the high voltage generating circuit 109 and the resistors R1 and R2. At the time of factory shipment, the high voltage generating circuit 109 uses the voltage Vreg1 from the DC power supply 104, which is an external power supply, as the high reference voltage Vref_HVT. The high voltage generating circuit 109 generates the output voltage Vout_HVT based on the voltage control signal Vcont that is output from the output port of the DA converter 130, and outputs the generated output voltage Vout_HVT. The relationship among the voltage control signal Vcont, the set value X set by the CPU 105 for the DA converter 130, and an operational voltage Vcc_CPU of the CPU 105 is as follows:

$$Vcont=(X/255)*Vcc_CPU \tag{12}$$

By feeding-back the detection voltage Vsns_HVT, which can be obtained by dividing the output voltage Vout_HVT using the resistors R1 and R2, to the high voltage generating circuit 109, the output voltage Vout_HVT becomes constant. The relationship among the output voltage Vout_HVT, the resistors R1 and R2, the detection voltage Vsns_HVT, and the high reference voltage Vref_HVT is as follows:

$$Vout_HVT=((R1+R2)/R2)*(Vsns_HVT-Vref_HVT)+Vref_HVT \tag{13}$$

In the state in which the output voltage Vout_HVT is stabilized, the following relationship among the set value X, the high reference voltage Vref_HVT, and the detection voltage Vsns_HVT is satisfied:

$$Vsns_HVT=(X/255)*Vref_HVT \tag{14}$$

Therefore, the following relationship is satisfied:

$$Vout_HVT=((R1+R2)/R2)*(Vsns_HVT-Vref_HVT)+Vref_HVT=((R1+R2)/R2)*((X/255)*Vref_HVT-Vref_HVT)+Vref_HVT=\{((R1+R2)/R2)*(X/255)-(R1+R2)/R2+1\}*Vref_HVT=\{((R1+R2)/R2)*(X/255)-R1/R2\}*Vref_HVT \quad (15)$$

Where the following coefficients A and B are used:

A=(R1+R2)/(255*R2)

B=R1/R2

By simplifying the formula (15) using the coefficients A and B, the formula (16) is obtained.

$$Vout_HVT=(A*X-B)*Vref_HVT \quad (16)$$

By substituting the formula (16) by the parameters that were used at the time of factory shipment, the formulae (17) and (18) are obtained:

$$V1d=(A*X1a-B)*Vreg1 \quad (17)$$

$$V2d=(A*X2a-B)*Vreg1 \quad (18)$$

The coefficients A and B are calculated using the formulae (17) and (18):

$$A=(V1d-V2d)/\{(X1a-X2a)*Vreg1\} \quad (19)$$

$$B=(V1d*X2a-V2d*X1a)/\{(X1a-X2a)*Vreg1\} \quad (20)$$

Also with respect to the set value X1*b* for outputting the desired output voltage V1*t* when Vref_HVT is Vreg1, the following formula is satisfied:

$$V1t=(A*X1b-B)*Vreg1 \quad (21)$$

When the formula (21) is simplified by being substituted by the formulae (19) and (20), the formula for obtaining X1*b* is obtained:

$$X1b=(V1t/Vreg1+B)/A=\{V1t*(X1a-X2a)+(V1d*X2a-V2d*X1a)\}/(V1d-V2d) \quad (22)$$

Similarly, with respect to the set value X2*b* for outputting the desired output voltage V2*t* when Vref_HVT is Vreg1, the following formula is satisfied:

$$X2b=(V2t/Vreg1+B)/A=\{V2t*(X1a-X2a)+(V1d*X2a-V2d*X1a)\}/(V1d-V2d) \quad (23)$$

The CPU 105 converts the set values X1*b* and X2*b* into 8-bit integers, and stores the converted integers in the memory 116.

The CPU 105 calculates corrected set values X1*c* and X2*c* using the set values X1*b* and X2*b* and the correction coefficient F, at the time of image formation. As described above, the correction coefficient F is calculated based on the comparison result Vreg_ad_ref stored in the memory 116 and the measured comparison result Vreg_ad_real. At the time of factory shipment, V1*t*, V2*t*, V1*d*, and V2*d* are also stored in the memory 116, together with X1*b* and X2*b*.

$$X1c=(1/F)*\{V1t*(X1b-X2b)/(V1d-V2d)\}+(V1d*X2b-V2d*X1b)/(V1d-V2d) \quad (23)$$

$$X2c=(1/F)*\{V2t*(X1b-X2b)/(V1d-V2d)\}+(V1d*X2b-V2d*X1b)/(V1d-V2d) \quad (24)$$

By setting the set value X1*c* for the DA converter 130, it is possible to correct an error caused due to variation in the voltage dividing resistors R1 and R2 for obtaining the reference voltage Vref_HVT and Vsns_HVT, and to output the desired output voltage V1*t* with accuracy. Similarly, the CPU 105 sets the set value X2*c* for the DA converter 130 in order to obtain the desired output voltage V2*t*.

Conclusion

Accordingly, in the present embodiment, a comparison result between the first reference voltage and the second reference voltage in the AD converter 113 that has been obtained in advance (for example, in the manufacturing process of the image forming apparatus) is stored in the memory 116. Then, the CPU 105 corrects the high-voltage set value X based on a comparison result of the AD converter 113 that is obtained by a user of the image forming apparatus at the time of use and the comparison result that is obtained in the manufacturing process and stored in the memory 116, and supplies the corrected high-voltage set value X to the DA converter 130. Note that the comparison result can be obtained by comparing the first reference voltage in the AD converter 113 that was supplied from the DC power supply 104 with the second reference voltage generated by the regulator 110. Since the regulator 110 can generate a constant voltage irrespective of the first reference voltage, it is easy to recognize a variation in the first reference voltage that was supplied from the DC power supply 104. Accordingly, by obtaining in advance the reference voltage comparison result, which serves as power supply information indicating a unique characteristic for each power supply apparatus, and then correcting the set value, the influence of a variation in the reference voltage that is supplied to the high voltage generating circuit 109 is reduced, making it possible to generate a high output voltage with accuracy. Furthermore, a certain degree of variation in accuracy can be accepted for the reference voltage that is generated by the DC power supply 104, and thus an expensive special IC for generating a voltage with high accuracy is no longer necessary. Therefore, a relatively inexpensive configuration can be employed for the present embodiment.

As described with reference to Embodiments 1 to 5, the CPU 105 may determine the correction coefficient F of the set value based on the comparison result that is obtained by the AD converter 113 when the image forming apparatus is in use and the comparison result that is obtained in the manufacturing process and stored in the memory 116. Furthermore, the CPU 105 may correct the set value X using the correction coefficient F. Accordingly, the memory 116 has stored a plurality of parameters for specifying a correction formula for correcting the high-voltage set value X, and the CPU 105 may correct the high-voltage set value using the correction formula that is specified by the parameters read out from the memory 116 and the calculated correction coefficient F. As described in Embodiment 1, in the manufacturing process of the image forming apparatus or the power supply apparatus, an external power supply for measurement that is provided outside the image forming apparatus may be used as the DC power supply 104. On the other hand, when the image forming apparatus is in use, an internal power supply that is located inside the image forming apparatus is used as the DC power supply 104. The AD converter 113 may compare the first reference voltage supplied from the internal power supply with the second reference voltage that the regulator 110 generated upon being supplied with the first reference voltage from the internal power supply, and output a comparison result. The CPU 105 correct the high-voltage set value X using the correction formula (10), which is specified by the first set value X1*a*, the first measurement value V1*d*, the second set value X2*a*, the second measurement value V2*d*, the correction coefficient F, and the like. According to this, it is possible to specify the correction formula only by storing the relatively small number of parameters in the memory 16, resulting in a decrease in the cost of the nonvolatile storage device. Note that the first measurement value V1*d* is a voltage that is measured when the DA converter 130 sets the first set value X1*a* in the manufacturing process of the image forming apparatus. The second measurement value V2*d* is a voltage measured when the DA converter 130 sets the second set value X2*a* in the manufacturing process of the image forming apparatus. The CPU 105 may also correct a high-voltage set value using the correction formula (23) or (24) that is specified by the first target value V1*t* that is high-voltage, the second target value V2*t* that is high-voltage, the first set value X1*b*, the second set value X2*b*, the correction coefficient F, and the like. According to this, it is possible to specify the correction formula only by storing the relatively small number of parameters in the memory 16, resulting in a decrease in the cost of the nonvolatile storage device. Note that the first set value X1*b* is a set value that is obtained so as to obtain the first target value V1*t* in the manufacturing process of the image forming apparatus. The second set value X2*b* is a set value that is obtained so as to obtain the second target value V2*t* in the manufacturing process of the image forming apparatus.

The AD converter 113 has been taken as an example of a comparing unit for comparing the first reference voltage and the second reference voltage, but another comparing circuit may be employed. An AD converter that is provided, for example, in the CPU 105 may be used as the AD converter 113. If the AD converter that is provided in the IC including the CPU 105 can be used as described above, another AD converter will not need to be added, leading to an advantage in view of the manufacturing cost. Furthermore, the AD converter 113 may be located outside of the IC including the CPU 105. The regulator 110 may be provided inside the IC including the CPU 105 or outside the IC. If the regulator 110 that is provided in the IC is used, another regulator 110 will not need to be added, leading to an advantage in view of the manufacturing cost. The DA converter 130 that converts the set value supplied from the CPU 105 into an analog signal and outputs the converted analog signal to the high voltage generating circuit 109 may be used as a setting unit. The DA converter 130 as well may be provided inside the IC including the CPU 105 or outside the IC. If the DA converter 130 that is provided in the IC is used, another DA converter 130 will not need to be added, leading to an advantage in view of the manufacturing cost.

A high voltage generated by the high voltage generating circuit 109 may be used as a charging voltage of the charging device 216. Furthermore, a high voltage generated by the high voltage generating circuit 109 may also be used as a developing voltage of the developing device 217. Furthermore, a high voltage generated by the high voltage generating circuit 109 may also be used as a primary transfer voltage that is to be applied to the primary transfer member 218 or a secondary transfer voltage that is to be applied to the secondary transfer roller 223. Note that high voltage generating circuits 109 may also be provided for the respective high voltages. By these high voltages being stabilized, there is advantages that density unevenness, color unevenness, or the like of toner images are reduced.

The DC power supply 104 may supply the first reference voltage also to the scanner unit 210, which is an exposure device. Although the first reference voltage drops due to an operation of the scanner unit 210, this drop is only a variation in the first reference voltage and it is thus possible to mitigate the influence of the variation in the first reference voltage by the present embodiment. Specifically, it is possible to mitigate the influence of a variation in the first reference voltage due to a difference between the monochrome mode and the multicolor mode. For example, the CPU 105 may let the AD converter 113 obtain a comparison result while putting the exposure device in operation, and correct the set value based on a difference in the first reference voltage caused due to the operation of the scanner unit 210. Thus, in order to obtain a comparison result, the scanner unit 210 needs to be operated. However, when the scanner unit 210 is operated, the photoreceptors 215 are irradiated with laser light and latent images are developed by the developing devices 217 into toner images, resulting in a toner consumption. In order to prevent this, the developing devices 217 and the photoreceptors 215 may respectively be moved away from each other. For example, the CPU 105 may put the exposure device in operation and lets the AD converter 113 obtain a comparison result in a preparation time period that is executed before image formation. Furthermore, the CPU 105 may also put an exposure device in operation and let the AD converter 113 obtain a comparison result in an interval between a time period in which multicolor image formation is performed and a time period in which monochrome image formation is performed. This is because, in these time periods and intervals, the developing devices 217 and the photoreceptors 215 are respectively moved away from each other.

As described with reference to FIGS. 11A to 11C, the image forming apparatus 201 includes, as a plurality of image forming units, image formation stations for YMCK each including a photoreceptor and a developing unit. The image forming apparatus 201 may further include a plurality of modes, and the solenoid 190 that is a switching unit for switching the plurality of modes under control of the CPU 105. The modes include a monochrome mode, a moved-away mode, a multicolor mode, and the like. The monochrome mode is a mode in which, for example, the photoreceptor and the developing unit of one of the plurality of image forming units are in contact in order to perform monochrome image formation. The moved-away mode is a mode in which, for example, the photoreceptors and the developing units of all of the plurality of image forming units are respectively moved away from each other. The multicolor mode is a mode in which, for example, the photoreceptors and the developing units of the plurality of image forming units are respectively in contact in order to perform multicolor image formation. As described with reference to FIGS. 11A to 11C and FIGS. 13A and 13B, these modes are switched in cycles. Accordingly, when switching from the monochrome mode to the multicolor mode via the moved-away mode is performed, the CPU 105 puts the exposure device in operation in the moved-away mode and lets the AD converter 113 obtain a comparison result. Furthermore, also when switching from the multicolor mode to the monochrome mode is performed, the CPU 105 puts the exposure device in operation in the moved-away mode and lets the AD converter 113 obtain a comparison result. That is, also when switching from the multicolor mode to the monochrome mode is performed, the CPU 105 executes the mode switching via the moved-away mode. For example, the CPU 105 first performs switching from the multicolor mode to the monochrome mode, then switching from the monochrome mode to the multicolor mode via the moved-away mode, and then switching from the multicolor mode to the monochrome mode. Accordingly, even when a plurality of modes is circulated in a specific order, the present embodiment can measure a comparison result without consuming a toner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-097107, filed May 8, 2014 which is hereby incorporated by reference wherein in its entirety.

What is claimed is:

1. An image forming apparatus comprising:

a setting unit configured to set a high-voltage set value;

a first generation unit configured to generate a high voltage based on the set value set by the setting unit and a first reference voltage supplied from a supply unit;

a second generation unit configured to generate a second reference voltage by being supplied with the first reference voltage from the supply unit;

a comparing unit configured to compare the first reference voltage with the second reference voltage;

a storage unit configured to store a comparison result that has been obtained in advance by the comparing unit comparing the first reference voltage with the second reference voltage; and a correction unit configured to correct the high-voltage set value based on a comparison result that is obtained by the comparing unit when the image forming apparatus is in use and the comparison result that has been obtained in advance and is stored in the storage unit.

2. The image forming apparatus according to claim 1, wherein the correction unit determines a correction coefficient of the set value based on the comparison result that is obtained by the comparing unit when the image forming apparatus is in use and the comparison result that has been obtained in advance and is stored in the storage unit.

3. The image forming apparatus according to claim 2, wherein an external power supply that is provided outside the image forming apparatus is used as the supply unit in a manufacturing process of the image forming apparatus, the storage unit has further stored a plurality of parameters for specifying a correction formula for use in correcting the high-voltage set value, and the correction unit corrects the high-voltage set value using the correction formula that is specified by the parameters read from the storage unit and the correction coefficient.

4. The image forming apparatus according to claim 3, wherein an internal power supply that is located inside the image forming apparatus is used as the supply unit when the image forming apparatus is in use, the comparing unit compares the first reference voltage supplied from the internal power supply with the second reference voltage that is generated by the second generation unit being supplied with the first reference voltage from the internal power supply, and outputs a comparison result.

5. The image forming apparatus according to claim 2, wherein an external power supply that is provided outside the image forming apparatus is used as the supply unit in a manufacturing process of the image forming apparatus, the correction unit corrects the high-voltage set value using a correction formula that is specified by a first set value, a first high-voltage measurement value that is measured when the setting unit sets the first set value in the manufacturing process of the image forming apparatus, a second set value, a second high-voltage measurement value that is measured when the setting unit sets the second set value in the manufacturing process of the image forming apparatus, and the correction coefficient.

6. The image forming apparatus according to claim 2, wherein an external power supply that is provided outside the image forming apparatus is used as the supply unit in a manufacturing process of the image forming apparatus, the correction unit corrects the high-voltage set value using a correction formula that is specified by a first high-voltage target value, a first set value that is obtained in the manufacturing process of the image forming apparatus such that the first target value is obtained, a second high-voltage target value, a second set value that is obtained in the manufacturing process of the image forming apparatus such that the second target value is obtained, and the correction coefficient.

7. The image forming apparatus according to claim 1, wherein the comparing unit is an AD converter.

8. The image forming apparatus according to claim 1, wherein the comparing unit is provided in an integrated circuit (IC) that includes the correction unit.

9. The image forming apparatus according to claim 1, wherein the comparing unit is located outside an IC including the correction unit.

10. The image forming apparatus according to claim 1, wherein the second generation unit is a regulator.

11. The image forming apparatus according to claim 1, wherein the second generation unit is provided inside an IC including the correction unit.

12. The image forming apparatus according to claim 1, wherein the second generation unit is located outside an IC including the correction unit.

13. The image forming apparatus according to claim 1, wherein the setting unit is a DA converter configured to convert the set value supplied by the correction unit into an analog signal and output the converted analog signal to the first generation unit.

14. The image forming apparatus according to claim 1, wherein the supply unit supplies the first reference voltage also to an exposure device.

15. The image forming apparatus according to claim 14, wherein the correction unit further corrects the set value based on a variation in the first reference voltage that is caused due to an operation of the exposure device.

16. The image forming apparatus according to claim 15, wherein the correction unit corrects the set value based on a variation in the first reference voltage that is caused due to an operation of the exposure device, by letting the comparing unit obtain the comparison result during the operation of the exposure device.

17. The image forming apparatus according to claim 16, wherein the correction unit puts the exposure device in operation and lets the comparing unit obtain the comparison result in a preparation time period before image formation.

18. The image forming apparatus according to claim 16, wherein the correction unit puts the exposure device in operation and lets the comparing unit obtain the comparison result in an interval between a time period in which multicolor image formation is performed and a time period in which monochrome image formation is performed.

19. The image forming apparatus according to claim 18, further comprising:

a plurality of image forming units each including a photoreceptor and a developing unit; and a switching unit configured to perform switching among a monochrome mode in which the photoreceptor and the developing unit of one image forming unit of the plurality of image forming units are in contact in order to perform the monochrome image formation, a moved-away mode in which the photoreceptors and the developing units of all of the plurality of image forming units are respectively moved away from each other, and a multicolor mode in which the photoreceptors and the developing units of the plurality of image forming units are respectively in contact in order to perform the multicolor image formation, in order, wherein, when switching from the monochrome mode to the multicolor mode via the moved-away mode is performed, the correction unit puts the exposure device in operation in the moved-away mode and lets the comparing unit obtain the comparison result, when switching from the multicolor mode to the monochrome mode is performed, switching from the multicolor mode to the monochrome mode, then switching from the monochrome mode to the multicolor mode via the moved-away mode, and then switching from the multicolor mode to the monochrome mode are performed, and the correction unit puts the exposure device in operation in the moved-away mode and lets the comparing unit obtain the comparison result.

20. The image forming apparatus according to claim 1, further comprising an image forming unit configured to form an image, wherein the high-voltage generated by the first generation unit is supplied to the image forming unit.

21. A power supply apparatus comprising:

a setting unit configured to set a high-voltage set value;

a first generation unit configured to generate a high voltage based on the set value set by the setting unit and a first reference voltage supplied from a supply unit;

a second generation unit configured to generate a second reference voltage by being supplied with the first reference voltage from the supply unit;

a comparing unit configured to compare the first reference voltage supplied from the supply unit with the second reference voltage generated by the generation unit;

a storage unit configured to store a comparison result that has been obtained in advance by the comparing unit comparing the first reference voltage with the second reference voltage; and a correction unit configured to correct the high-voltage set value based on a comparison result that is obtained by the comparing unit when the power supply apparatus is in use and the comparison result that has been obtained in advance and is stored in the storage unit, and to supply the corrected high-voltage set value to the setting unit.

* * * * *